US011041335B2

(12) United States Patent
Chen

(10) Patent No.: US 11,041,335 B2
(45) Date of Patent: Jun. 22, 2021

(54) HINGE

(71) Applicants: WATERSON CORP., Taichung (TW); Waterson Chen, Taichung (TW)

(72) Inventor: Waterson Chen, Taichung (TW)

(73) Assignees: WATERSON CORP., Taichung (TW); Waterson Chen, Taichung (TW)

( * ) Notice: Subject to any disclaimer, the term of this patent is extended or adjusted under 35 U.S.C. 154(b) by 4 days.

(21) Appl. No.: 16/217,149

(22) Filed: Dec. 12, 2018

(65) Prior Publication Data

US 2020/0190884 A1 Jun. 18, 2020

(51) Int. Cl.

| | |
|---|---|
| ***E05F 3/20*** | (2006.01) |
| ***E05F 3/08*** | (2006.01) |
| ***E05F 1/12*** | (2006.01) |

(52) U.S. Cl.

CPC ..... *E05F 3/20* (2013.01); *E05F 1/1215* (2013.01); *E05F 3/08* (2013.01); *E05Y 2900/132* (2013.01)

(58) Field of Classification Search

CPC ... E05F 1/08; E05F 1/10; E05F 1/1008; E05F 1/12; E05F 1/1207; E05F 1/1223; E05F 1/14; E05F 1/02; E05F 1/043; E05F 1/06; E05F 1/061; E05F 3/20; E05F 3/08; E05F 201/1215

USPC ..... 16/309

See application file for complete search history.

(56) References Cited

U.S. PATENT DOCUMENTS

| | | | | | |
|---|---|---|---|---|---|
| 2,493,118 | A * | 1/1950 | Diebel | E05F 3/20 | 16/82 |
| 5,152,029 | A * | 10/1992 | Pai | E05D 5/10 | 16/54 |
| 5,855,040 | A * | 1/1999 | Lin | E05D 5/10 | 16/50 |
| 7,870,642 | B1 * | 1/2011 | Finkelstein | E05D 7/0423 | 16/242 |
| 9,617,772 | B1 * | 4/2017 | Chen | E05F 1/1215 | |
| 2006/0032021 | A1 * | 2/2006 | Fukuo | E05F 1/1223 | 16/298 |
| 2009/0007379 | A1 * | 1/2009 | Zhang | E05D 11/1042 | 16/295 |
| 2009/0133217 | A1 * | 5/2009 | Lin | E05F 1/1215 | 16/277 |
| 2009/0165250 | A1 * | 7/2009 | Duan | E05F 1/1207 | 16/343 |
| 2009/0265889 | A1 * | 10/2009 | Pan | E05F 3/14 | 16/308 |

(Continued)

FOREIGN PATENT DOCUMENTS

| | | | | |
|---|---|---|---|---|
| CA | 2930286 A1 * | 11/2017 | E05D 5/00 | |
| DE | 102014103558 B3 * | 5/2015 | E05F 1/12 | |

(Continued)

*Primary Examiner* — Emily M Morgan

(74) *Attorney, Agent, or Firm* — Burris Law, PLLC

(57) ABSTRACT

A hinge includes a leaf unit, first and second action units and an axle unit. The leaf unit includes first and second leaves that are rotatable relative to each other. The first leaf has a first barrel. The second leaf has a second barrel. The first and second action units are co-rotatable with the first leaf. The axle unit includes a fixing member mounted in the second barrel and co-rotatable with the second leaf, and first and second axle constituents respectively associated with the first and second action units and co-rotatable with the fixing member.

11 Claims, 27 Drawing Sheets

(56) References Cited

U.S. PATENT DOCUMENTS

| | | | | |
|---|---|---|---|---|
| 2010/0102494 | A1* | 4/2010 | Dug | F41H 5/22 267/140.12 |
| 2013/0205543 | A1* | 8/2013 | Chen | E05F 1/1215 16/301 |
| 2015/0233164 | A1* | 8/2015 | Bacchetti | E05F 1/1223 16/54 |
| 2016/0237730 | A1* | 8/2016 | Bacchetti | E05F 1/1223 |
| 2019/0145141 | A1* | 5/2019 | Jo | E05F 3/04 16/54 |
| 2019/0145143 | A1* | 5/2019 | Milnes | E05F 3/20 435/307.1 |

FOREIGN PATENT DOCUMENTS

| | | | | |
|---|---|---|---|---|
| TW | I580856 | * 12/2014 | | E05F 3/14 |
| TW | I580856 | 5/2017 | | |

* cited by examiner

HINGE

FIELD

The disclosure relates to a hinge, and more particularly to an adjustable hinge.

BACKGROUND

A conventional hinge disclosed in Taiwanese Patent No. 1580856 includes a leaf unit that has first and second leaves that are rotatable relative to each other, and two action modules that are mounted in the leaf unit. Each of the action modules includes a casing that is co-rotatable with the first leaf, and an operating shaft that is co-rotatable with the second leaf. The casing and the operating shaft of each of the action modules are rotated relative to each other upon the relative rotation between the first and second leaves, so as to generate an actuating force that acts between the first and second leaves.

However, to co-rotatably mount the operating shaft of each of the action modules to the second leaf, an inner surrounding surface of the second leaf need to be formed with mounting structures that correspond to the operating shafts of the action modules. Such mounting structures may not be machined easily.

SUMMARY

Therefore, an object of the disclosure is to provide a hinge that can alleviate the drawback of the prior art.

According to the disclosure, the hinge is adapted to interconnect first and second objects, and includes a leaf unit, two action units and an axle unit. The leaf unit includes first and second leaves that are rotatable relative to each other. The first leaf has at least one first barrel. The second leaf has at least one second barrel that is spaced apart from the first barrel along an axis. The action units are inserted into the first barrel and the second barrel respectively in two opposite directions along the axis, and are co-rotatable with the first leaf. The axle unit includes a fixing member that is mounted in the second barrel of the second leaf and that is co-rotatable with the second leaf, and two axle constituents that are respectively associated with the action units and that are co-rotatable with the fixing member. Each of the axle constituents and the corresponding action unit are rotated relative to each other upon relative rotation between the first and second leaves so that the corresponding action unit generates an actuating force that acts between the first and second leaves.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
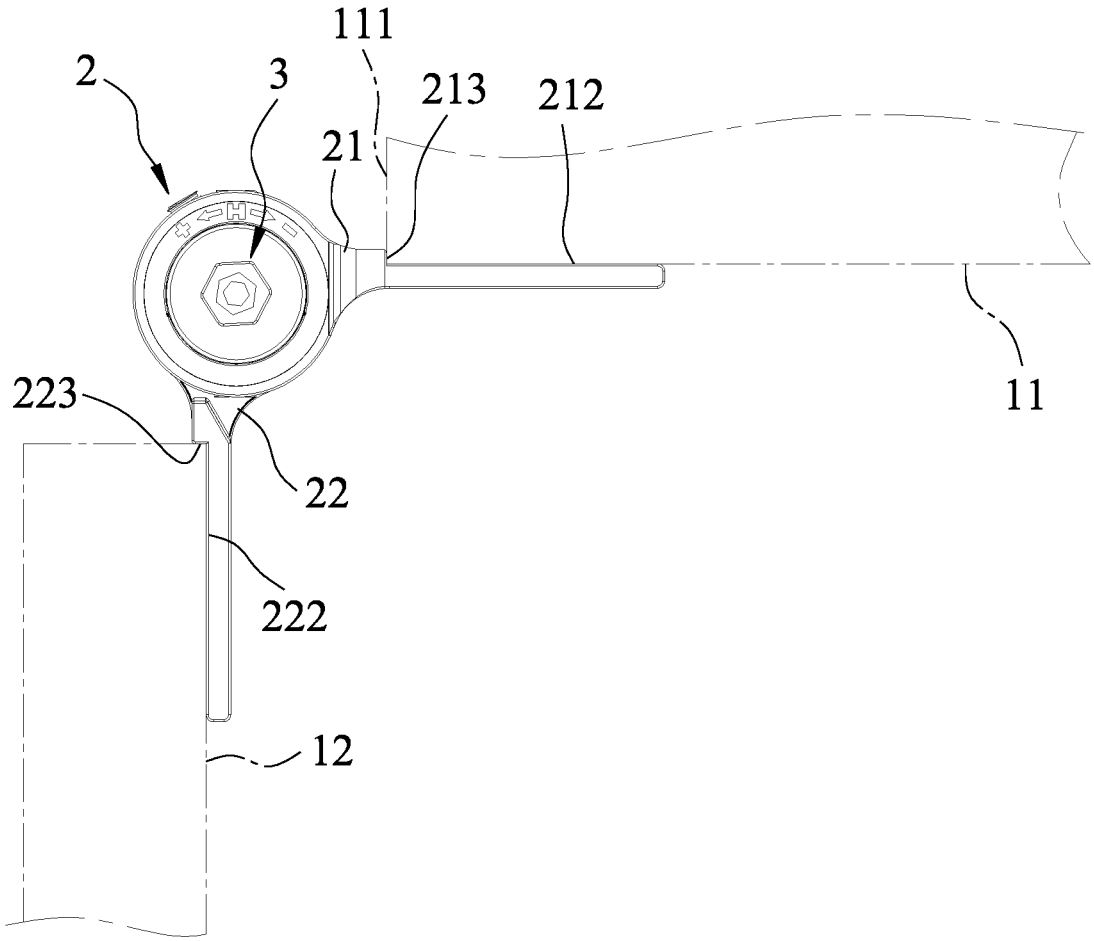
FIG. 1 is a top view illustrating a first embodiment of the hinge according to the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
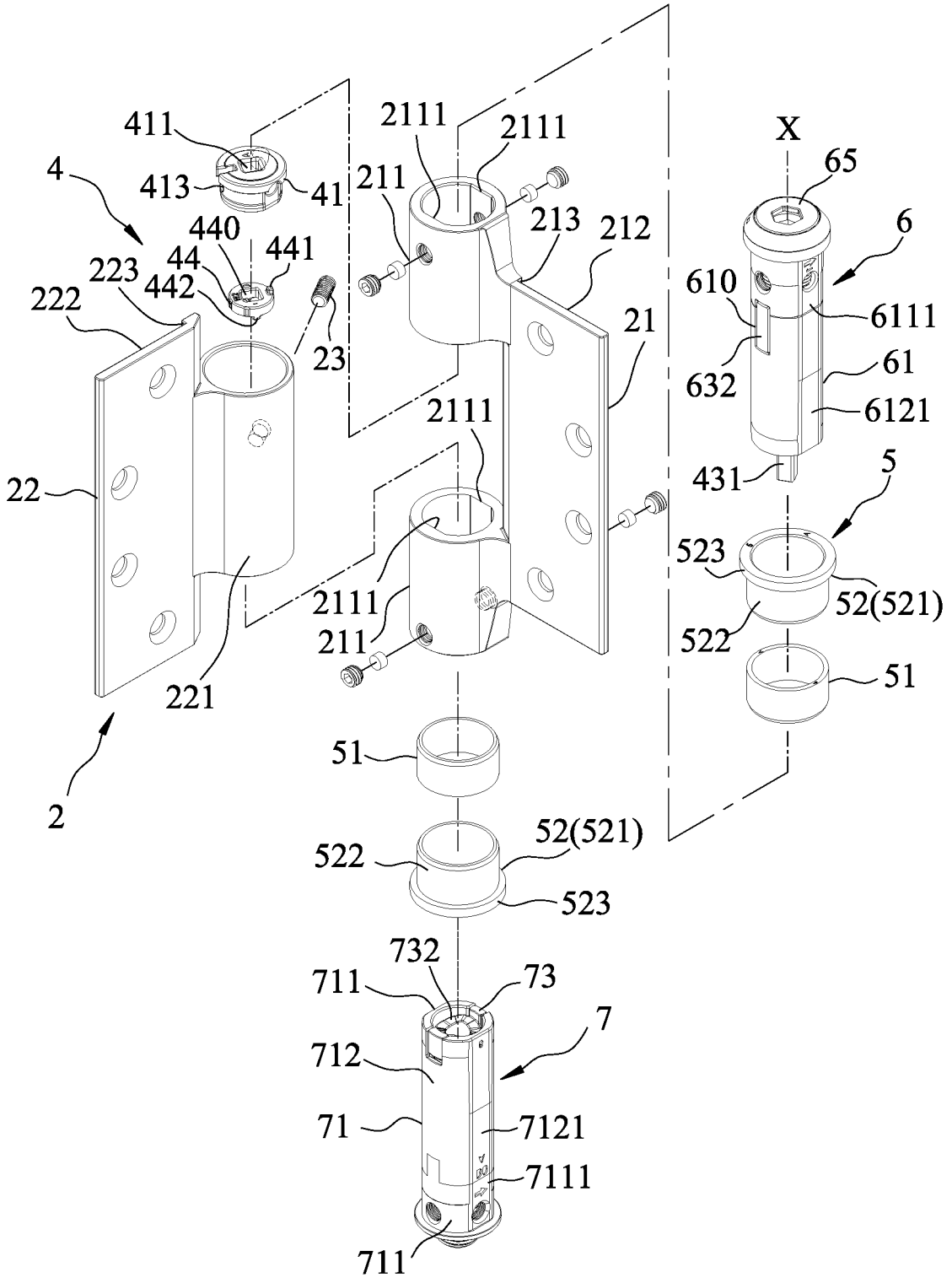
FIG. 2 is a partly exploded perspective view illustrating the first embodiment.

Referring to FIGS. 1 and 2, the first embodiment of the hinge according to the disclosure is for interconnecting first and second objects 11, 12 (e.g., a door frame and a door leaf), and includes a leaf unit 2, a first action unit 6, a second action unit 7, an axle unit 4 and a ring unit 5.

The leaf unit 2 includes first and second leaves 21, 22 that are rotatable relative to each other. Each of the first leaf 21 and the second leaf 22 is made of metal.

In one embodiment, the first leaf 21 has two first barrels 211 that are spaced apart from each other along an axis (X), a first clinging surface 212 that clings to the first object 11, and a first positioning surface 213 that is parallel to the axis (X), that is connected to the first clinging surface 212 and that is not coplanar with the first clinging surface 212. The first positioning surface 213 permits an edge 111 of the first object 11 to abut thereagainst. Each of the first barrels 211 has two inner limiting planes 2111 that are formed on an inner surrounding surface thereof.

The second leaf 22 has a second barrel 221 that is disposed between the first barrels 211 and that is spaced apart from the first barrels 211 along the axis (X), a second clinging surface 222 that clings to the second object 12, and a second positioning surface 223 that is parallel to the axis (X), that is connected to the second clinging surface 222 and that is not coplanar with the second clinging surface 222. The second positioning surface 223 permits an edge 121 of the second object 12 to abut thereagainst.

Figure 3:
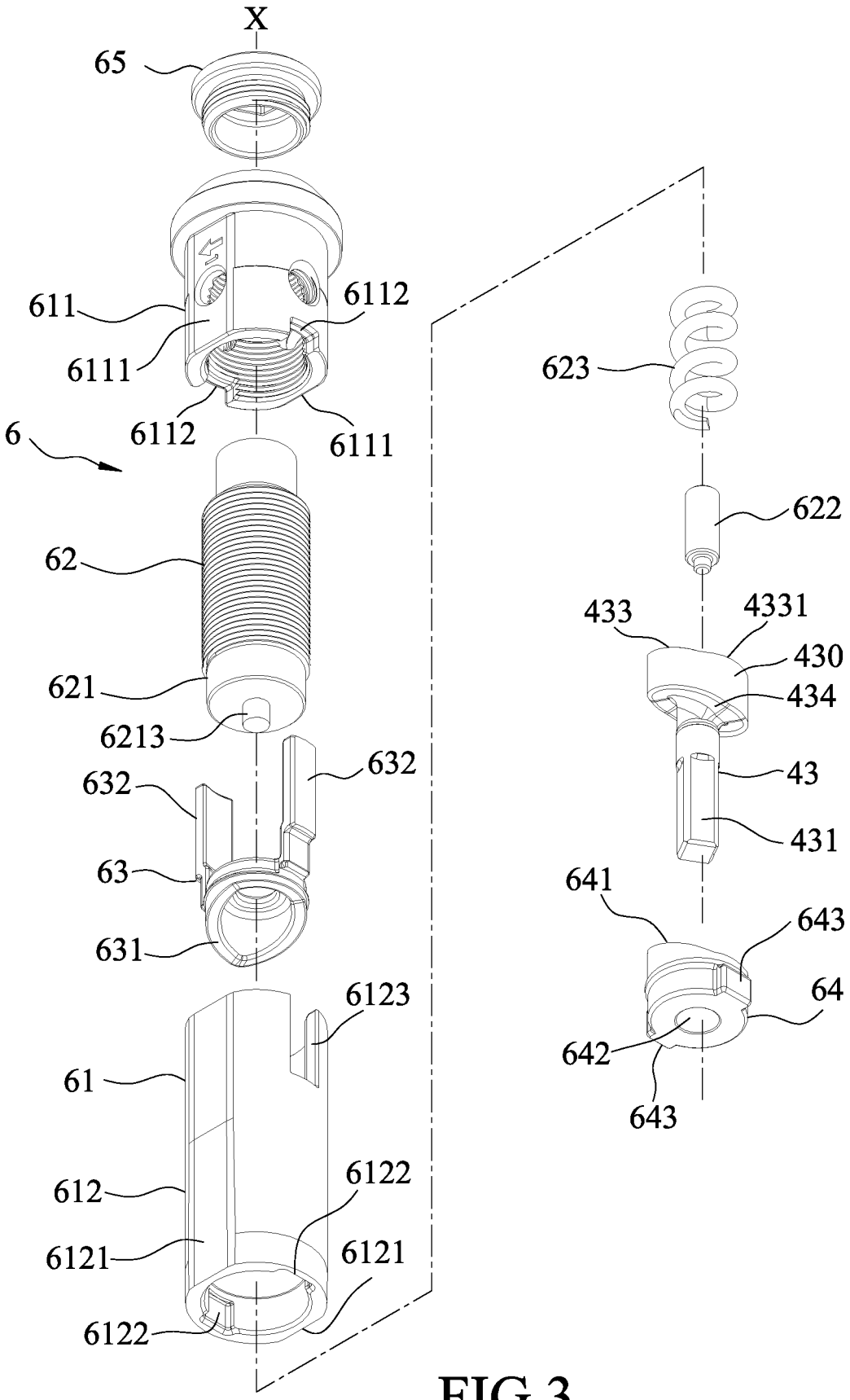
FIG. 3 is an exploded perspective view illustrating a first action unit of the first embodiment.
Figure 4:
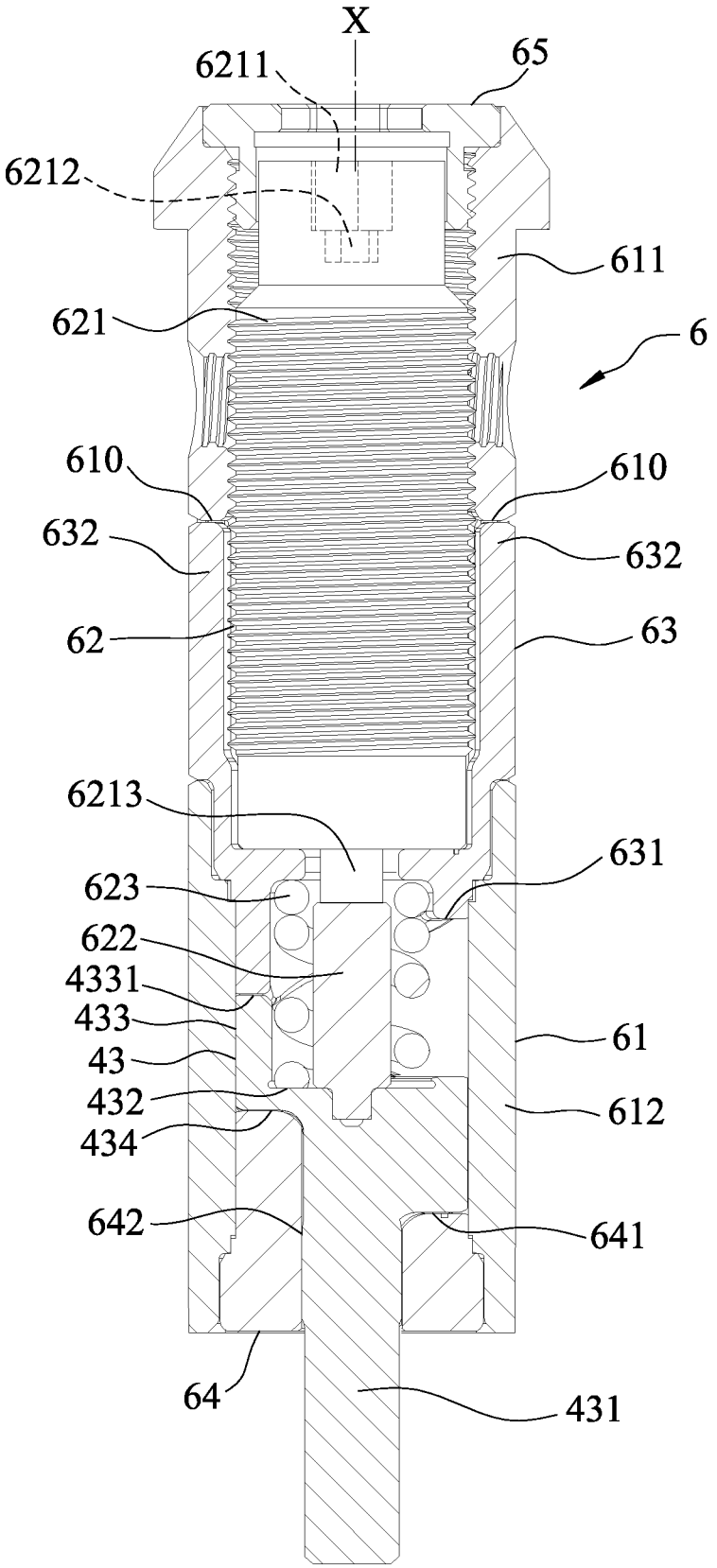
FIG. 4 is a sectional view illustrating the first action unit.

Referring further to FIGS. 3 and 4, the first action unit 6 includes a first tubular member 61 that is inserted into the first and second barrels 211, 221 and that is co-rotatable with the first leaf 21, a hydraulic module 62 that is disposed in the first tubular member 61, a distal acting member 63 that is co-rotatably mounted in the first tubular member 61, a proximal acting member 64 that is co-rotatably mounted in the first tubular member 61, and a cap member 65 that is mounted to an end of the first tubular member 61.

The first tubular member 61 has a first tube section 611, and a second tube section 612 that abuts against the first tube section 611. The first tube section 611 has two outer limiting planes 6111 that are formed at an outer surrounding surface thereof and that respectively abut against the inner limiting planes 2111 of one of the first barrels 211, and two mounting grooves 6112 each of which extends from an end of the first tube section 611 in the direction of the axis (X). The second tube section 612 has two outer limiting planes 6121 that are formed at an outer surrounding surface thereof and that respectively abut against the inner limiting planes 2111 of one of the first barrels 211, two spaced-apart positioning recesses 6122 that are formed in an inner surrounding surface thereof, and two mounting grooves 6123 each of which extends from an end of the second tube section 612 in the direction of the axis (X). Each of the mounting grooves 6112 of the first tube section 611 cooperates with a respective one of the mounting grooves 6123 of the second tube section 612 to form a mounting space 610 (see FIG. 4). By such, the first tubular member 61 is co-rotatable with the first leaf 21 by the cooperation among the outer limiting planes 6111, 6121 and the inner limiting planes 2111. It should be noted that the two-piece first tubular member 61 is easy to be assembled with other components, and the first and second tube sections 611, 612 can be made of different materials. A junction between the first and second tube sections 611, 612 of the first tubular member 61 should be located within one of the first barrels 211.

The hydraulic module 62 includes a hydraulic cylinder 621, an abutment pin 622 that abuts against the hydraulic cylinder 621, and a resilient member 623 that abuts against the hydraulic cylinder 621. The hydraulic cylinder 621 threadably engages the first tube section 611 of the first tubular member 61, and has a hexagonal setting hole 6211 that extends along the axis (X) and that is accessible through the cap member 65, a hexagonal throttle hole 6212, and a telescopic protrusion 6213 that is opposite to the setting hole 6211 and that abuts against the abutment pin 622.

The distal acting member 63 is mounted to the first and second tube sections 611, 612 of the first tubular member 61, and has a distal inclined surface 631, and two mounting blocks 632 each of which engages a respective one of the mounting grooves 6112 of the first tube section 611 and a corresponding one of the mounting grooves 6123 of the second tube section 612 (i.e., resides within a respective one of the mounting spaces 610), so that the distal acting member 63 is co-rotatable with the first tubular member 61.

The proximal acting member 64 has a proximal inclined surface 641, a through hole 642, and two spaced-apart positioning protrusions 643 that are formed on an outer surrounding surface thereof. The positioning protrusions 643 of the proximal acting member 64 respectively engage the positioning recesses 6122 of the second tube section 612, so that the proximal acting member 64 is co-rotatable with the first tubular member 61.

Figure 5:
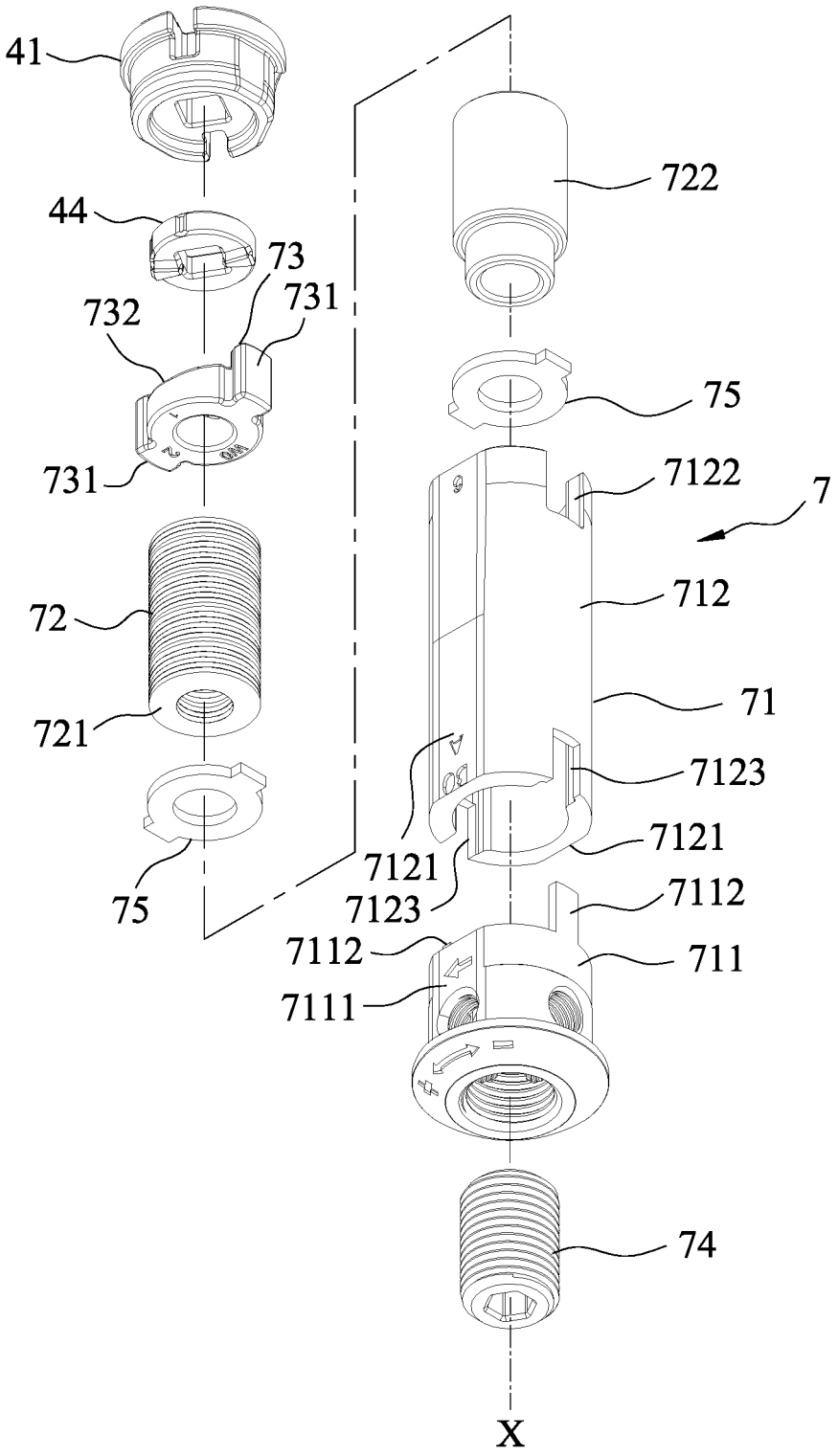
FIG. 5 is an exploded perspective view illustrating a second action unit of the first embodiment.
Figure 6:
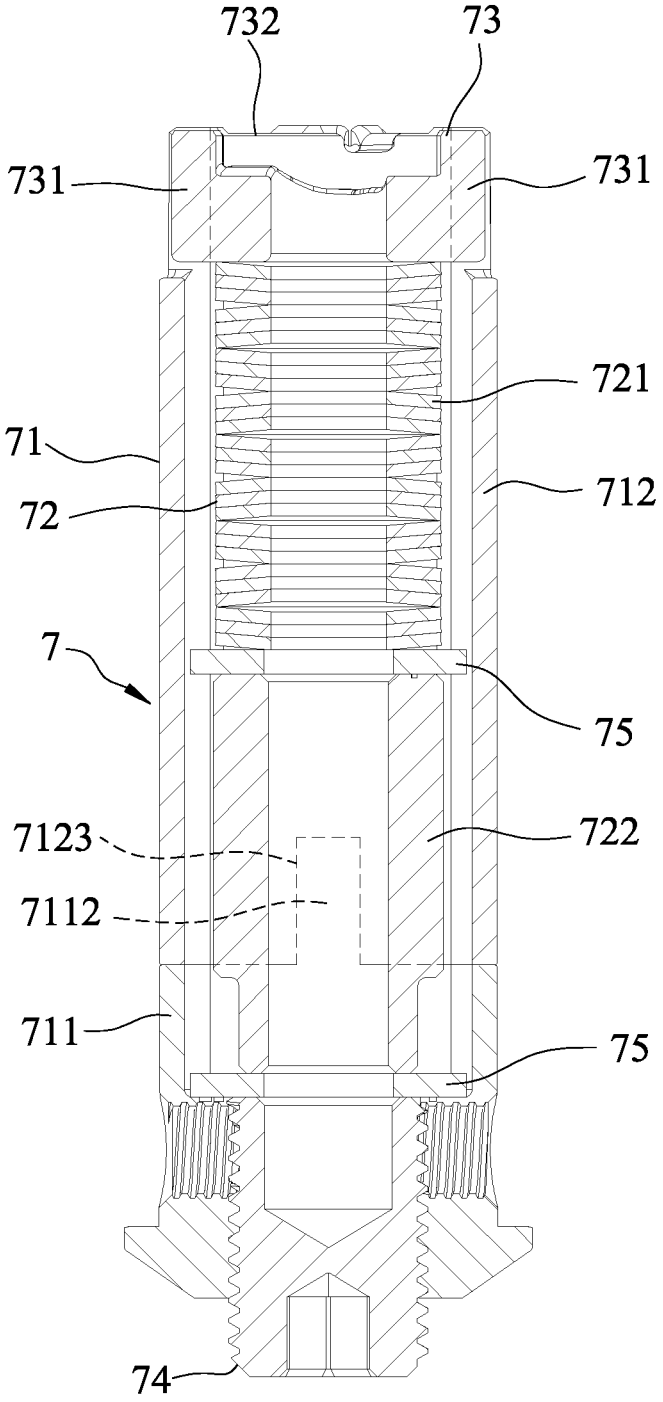
FIG. 6 is a sectional view illustrating the second action unit.
Figure 7:
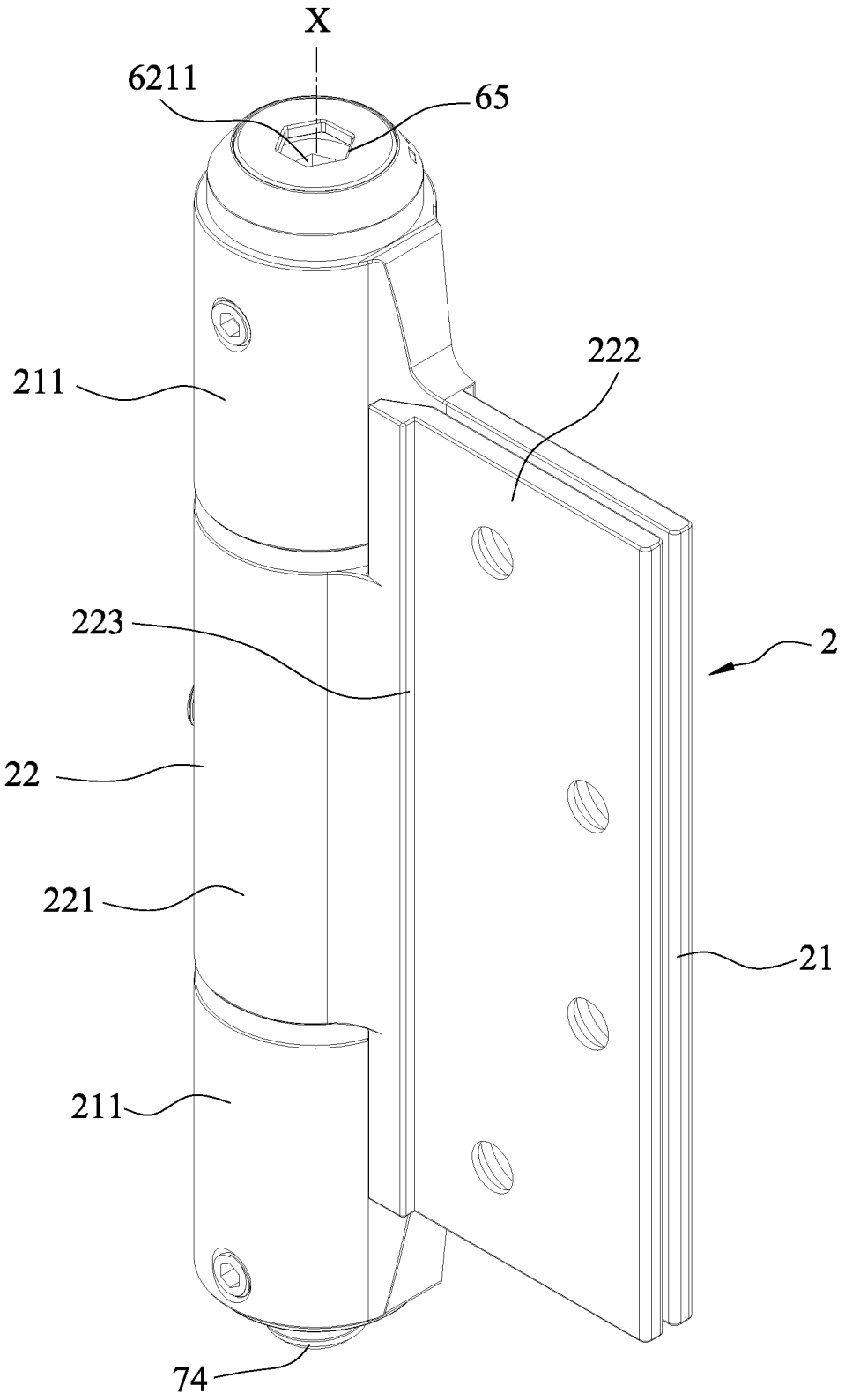
FIG. 7 is an assembled perspective view illustrating the first embodiment.

Referring further to FIGS. 5 and 6, the second action unit 7 includes a second tubular member 71 that is inserted into the first and second barrels 211, 221 and that is co-rotatable with the first leaf 21, a disc spring assembly 72 that is disposed in the second tubular member 71, a friction member 73 that abuts against the disc spring assembly 72 and that is co-rotatable with the second tubular member 71, an adjusting member 74 that engages threadably the second tubular member 71 and that pushes the disc spring assembly 72, and a plurality of washers 75 disposed in the second tubular member 71. In this embodiment, the second action unit 7 includes two tab washers 75.

The second tubular member 71 has a first tube section 711, and a second tube section 712 that abuts against the first tube section 711. The first tube section 711 has two outer limiting planes 7111 (only one is visible in FIG. 5) that are formed at an outer surrounding surface thereof and that respectively abut against the inner limiting planes 2111 of one of the first barrels 211, and two mounting blocks 7112 each of which extends from an end of the first tube section 711 in the direction of the axis (X). The second tube section 712 has two outer limiting planes 7121 that are formed at an outer surrounding surface thereof and that respectively abut against the inner limiting planes 2111 of one of the first barrels 211, two spaced-apart positioning recesses 7122 (only one is shown in FIG. 5) that are formed at an end of the second tube section 712, and two spaced-apart mounting grooves 7123 each of which extends from an opposite end of the second tube section 712 in the direction of the axis (X) and is engaged with a respective one of the mounting blocks 7112 of the first tube section 711.

The disc spring assembly 72 includes a plurality of disc springs 721 that are disposed between the friction member 73 and one of the washers 75, and a padding member 722 that is disposed between the washers 75. The friction member 73 has two spaced-apart positioning protrusions 731 that are formed on an outer surrounding surface thereof and that respectively engage the positioning recesses 7122 of the second tube section 712 so that the friction member 73 is co-rotatable with the second tubular member 71. The friction member 73 further has a friction surface 732 that is formed at an end thereof distal from the disc spring assembly 72.

By such, the second tubular member 71 is co-rotatable with the first leaf 21 by the cooperation among the outer limiting planes 7111, 7121 and the inner limiting planes 2111. It should be noted that the two-piece second tubular member 71 is easy to be assembled with other components, and the first and second tube sections 711, 712 can be made of different materials. A junction between the first and second tube sections 711, 712 of the second tubular member 71 should be located within one of the first barrels 211.

Referring back to FIGS. 2 and 3, in this embodiment, the axle unit 4 includes a fixing member that is removably mounted in the second barrel 221 of the second leaf 22 by a fastener 23 and that is co-rotatable with the second leaf 22, a first axle constituent 43 (see FIG. 3) that is mounted to the first action unit 6 and that is co-rotatably connected to the fixing member 41, and a second axle constituent 44 (see FIG. 2) that is mounted to the second action unit 7 and that is co-rotatably connected to the fixing member 41. In one embodiment, the first axle constituent 43 is located between the fixing member 41 and the hydraulic cylinder 621.

The fixing member 41 has a rectangular fixing hole 411 that is formed in one of two opposite end surfaces of the fixing member 41 along the axis (X) and that extends along the axis (X), a fixing recess 412 (see FIG. 8) that is formed in the other one of the opposite end surfaces of the fixing member 41, and two fixing grooves 413 (only one is visible in FIG. 2) that are respectively formed in the opposite end surfaces of the fixing member 41. In one embodiment, the fixing recess 412 is configured as a circular recess. In one embodiment, the fixing hole 411 is formed through the opposite end surfaces of the fixing member 41. In one embodiment, the fixing member 41 has a circular outer surrounding surface that abuts against an inner surrounding surface of the second barrel 221 of the second leaf 22.

Referring back to FIG. 3, the first axle constituent 43 has a follower portion 430 that is disposed between the distal acting member 63 and the proximal acting member 64, and an axle portion 431 that extends through the through hole 642 of the proximal acting member 64 and that co-rotatably engages the fixing hole 411 of the fixing member 41. The follower portion 430 has an abutment surface 432 (see FIG. 8) that is opposite to the axle portion 431 and that abuts against the abutment pin 622 and the resilient member 623, a surrounding wall 433 that cooperates with the abutment surface 432 to define a recess, and a proximal follower surface 434 that is opposite to the abutment surface 432 and that faces toward the proximal inclined surface 641 of the proximal acting member 64. The surrounding wall 433 has a distal follower surface 4331 that is opposite to the proximal follower surface 434 and that faces toward the distal inclined surface 631 of the distal acting member 63. In this embodiment, the axle portion 431 has configured as a rectangular cross-section.

Referring to FIG. 2, the second axle constituent 44 has a fixing hole 440 that is co-rotatably engaged with the axle portion 431 of the first axle constituent 43, a post 441 that co-rotatably engages a corresponding one of the fixing grooves 413 of the fixing member 41, and two protrusions 442 (only one is visible in FIG. 2) that protrude toward the friction surface 732 of the friction member 73 of the second action unit 7. In this embodiment, the fixing hole 440 is configured as a rectangular hole. The post 441 may co-rotatably engages the fixing recess 412 of the fixing member 41 by modifying the shape of the fixing recess 412. The protrusions 442 of the second axle constituent 44 are in frictional contact with the friction surface 732 of the friction member 73 of the second action unit 7, so that the second action unit 7 may generate an actuating force that acts between the first and second leaves 21, 22 when the second axle constituent 44 and the second action unit 7 are rotated relative to each other. The profile of the friction surface 732 of the friction member 73 may be configured such that the first and second leaves 21, 22 are held relative to each other when an angle formed between the first and second leaves 21, 22 reaches a predetermined value or range, or may be configured such that the second action unit 7 retards the relative rotation between the first and second leaves 21, 22 when the angle formed between the first and second leaves 21, reaches a predetermined value or range, and is not limited to such.

Figure 8:
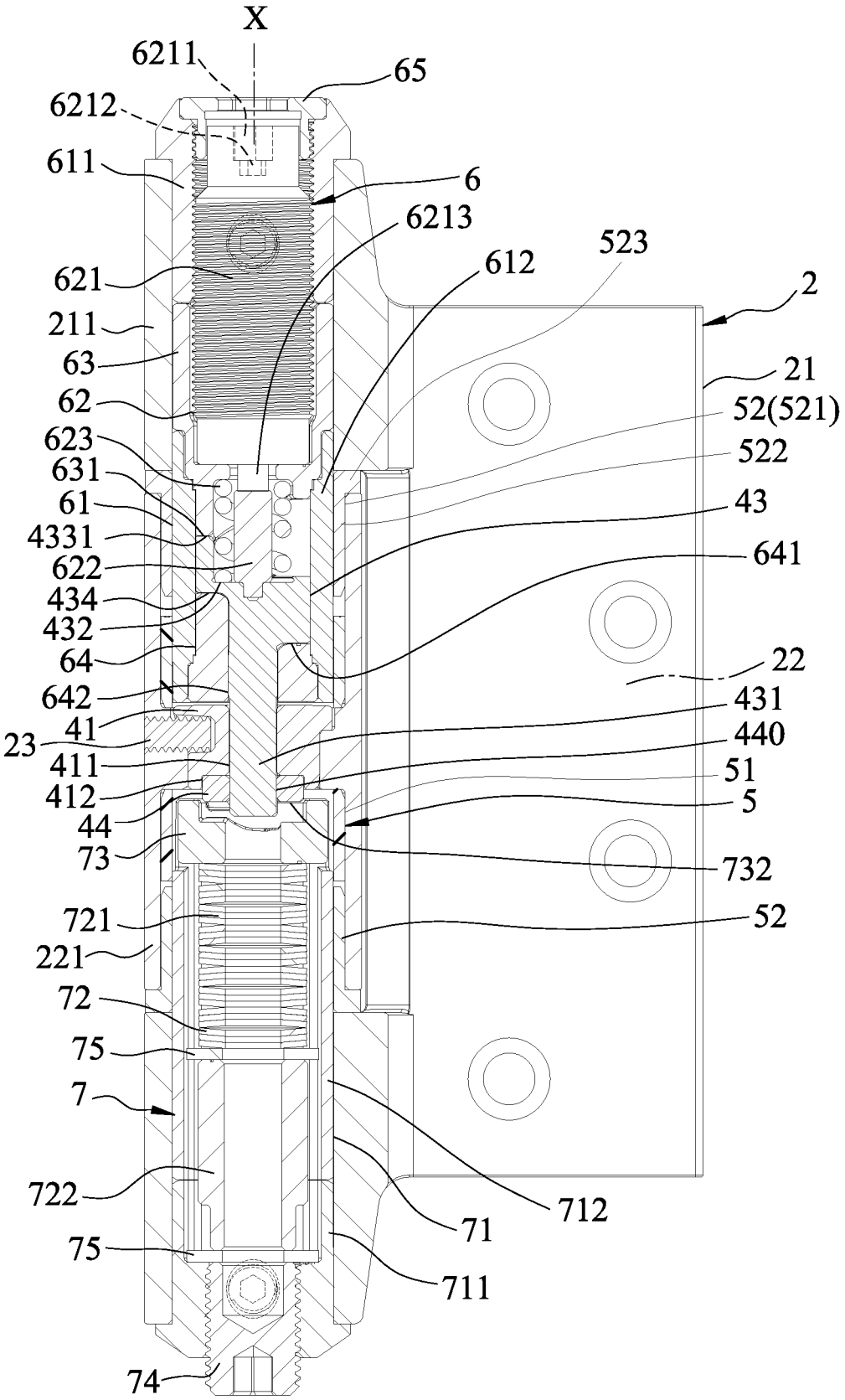
FIG. 8 is a sectional view illustrating the first embodiment.

Referring to FIGS. 2 and 8, the ring unit 5 includes two ring members 51 and two spacer assemblies 52. The ring members 51 are respectively disposed between the first tubular member 61 and the second barrel 221 and between the second tubular member 71 and the second barrel 221. Each of the spacer assemblies 52 includes a spacer 521. Each of the spacers 521 of the spacer assemblies 52 has an surrounding wall 522 that is disposed between the second barrel 221 and a respective one of the first tubular member 61 and the second tubular member 71, and a flange wall 523 that is disposed between the second barrel 221 and a respective one of the first barrels 211. Each of the ring members 51 and the spacer assemblies 52 may be made of Polyoxymethylene (POM) or Polytetrafluoroethylene (PTFE), and serves as a bushing for facilitating relative rotation between the corresponding components.

During installation of the hinge onto the first and second objects 11, 12, the first leaf 21 can be quickly and accurately positioned relative to the first object 11 by moving the first positioning surface 213 to abut against the edge 111 of the first object 11, and the second leaf 22 can be quickly and accurately positioned relative to the second object 12 by moving the second positioning surface 223 to abut against the edge 121 of the second object 12. As such, the first and second objects 11, 12 are accurately positioned relative to each other, and can be smoothly rotated relative to each other.

Referring to FIGS. 1 to 8, when the first and second leaves 21, 22 are rotated relative to each other in the direction of the arrow shown in FIG. 1 by an external force, the first axle constituent 43 is rotated relative to the distal and proximal acting members 63, 64, and the proximal inclined surface 641 of the proximal acting member 64 pushes the proximal follower surface 434 of the first axle constituent 43 to move the first axle constituent 43 toward the hydraulic cylinder 621 and to push the distal follower surface 4331 against the distal inclined surface 631 of the distal acting member 63. As such, the first axle constituent 43 pushes the abutment pin 622 to press the telescopic protrusion 6213 of the hydraulic cylinder 621 for controlling the relative rotational speed between the first and second leaves 21, 22, and the abutment surface 432 of the first axle constituent 43 pushes and compresses the resilient member 63 to generate a restoring force (i.e., an actuating force).

At the same time, the second axle constituent 44 is rotated relative to the friction member 73, and pushes the friction member 73 to compress the disc spring assembly 72 to generate the actuating force.

When the external force is removed, the resilient member 623 pushes the first axle constituent 43 to move away from the hydraulic cylinder 621, and therefore the proximal follower surface 434 of the first axle constituent 43 pushes the proximal inclined surface 641 of the proximal acting member 64 to rotate the first axle constituent 43 and the proximal acting member 64 relative to each other, so as to rotate the first and second leaves 21, 22 relative to each other in a direction opposite to the arrow shown in FIG. 1.

It should be noted that, in one embodiment, the distal follower surface 4331 of the first axle constituent 43 is in contact with the distal inclined surface 631 of the distal acting member 63 when the first and second leaves 21, 22 are rotated relative to each other in the direction opposite to the arrow shown in FIG. 1.

It should also be noted that, the first leaf 21 can be connected to any one of a door leaf and a door frame while the second leaf 22 is connected to the other one of the door leaf and the door frame.

The hexagonal setting hole 6211 of the hydraulic cylinder 621 permits a hand tool to engage therewith. By rotating the hand tool, the hydraulic cylinder 621 is moved relative to the first tubular member 61 along the axis (X), and the relative position between the hydraulic cylinder 621 and the first axle constituent 43 is adjusted, so that the range of the angle formed between the first and second leaves 21, 22 within which the hydraulic cylinder 621 works can be adjusted. The hexagonal throttle hole 6212 of the hydraulic cylinder 621 permits another hand tool to engage therewith. By rotating the hand tool, the damping coefficient of the hydraulic cylinder 621 can be adjusted.

In addition, by moving the adjusting member 74 along the axis (X), the actuating force generated by the disc spring assembly 72 can be adjusted. By substituting the friction member 73 with another friction member 73 that has a friction surface 732 with different profile, the disc spring assembly 72 is able to generate the actuating force when the angle formed between the first and second leaves 21, 22 reaches a predetermined value or range.

Figure 9:
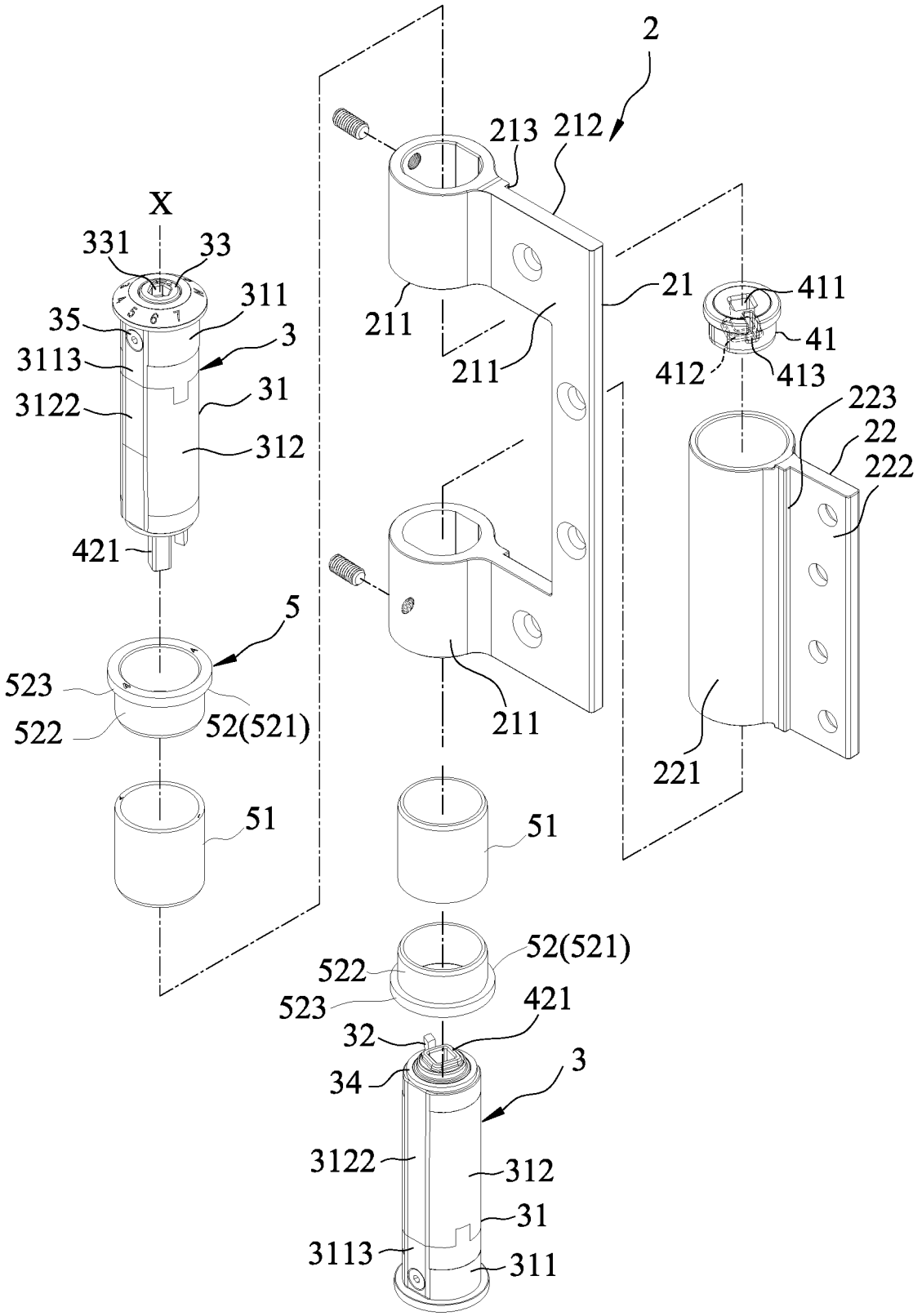
FIG. 9 is a partly exploded perspective view illustrating a second embodiment of the hinge according to the disclosure.
Figure 10:
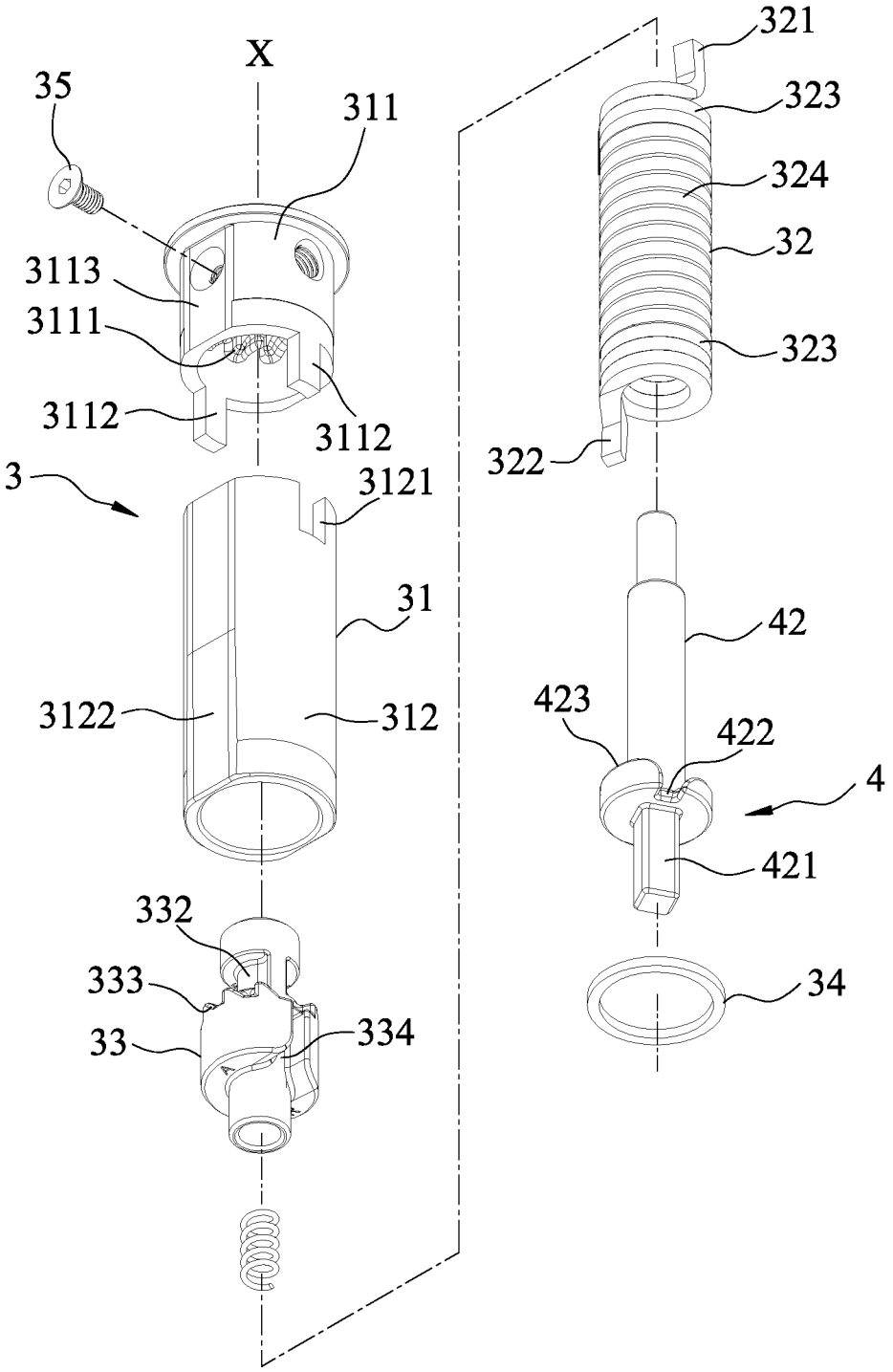
FIG. 10 is an exploded perspective view illustrating one of two torsional action units of the second embodiment.
Figure 11:
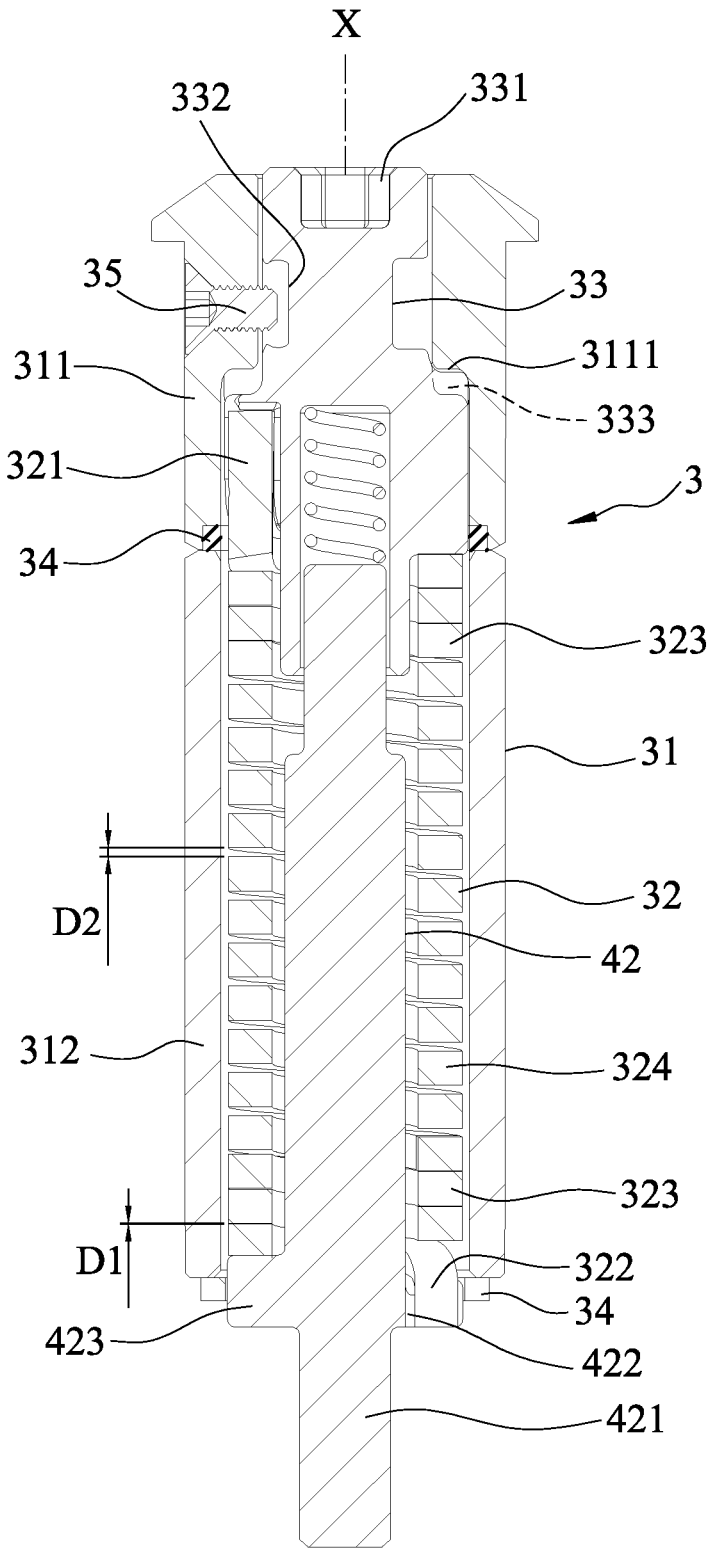
FIG. 11 is a sectional view illustrating the one of the torsional action units.

Referring to FIGS. 9 and 10, a second embodiment of the hinge according to the disclosure is similar to the first embodiment, and includes the leaf unit 2, the axle unit 4, the ring unit 5, and two torsional action units 3.

In this embodiment, the first leaf 21 is U-shaped and defines a receiving space, and the second leaf 22 is disposed in the receiving space of the first leaf 21.

Referring to FIGS. 10 to 13, the torsional action units 3 are inserted into the first barrels 211 and the second barrel 221 respectively in two opposite directions along the axis (X). Each of the torsional action units 3 includes a torsional tubular member 31 that is inserted into the first and second barrels 211, 221 and that is co-rotatable with the first leaf 21, a torsion spring 32 that is disposed in the torsional tubular member 31 for generating a restoring force, an adjusting member 33 that is rotatably disposed in the torsional tubular member and that can be positioned relative to the torsional tubular member 31, two limiting rings 34 (see FIGS. 11 and 12), and a set screw 35.

The torsional tubular member 31 has a first tube section 311, and a second tube section 312 that abuts against the first tube section 311. The first tube section 311 has a toothed portion 3111 formed at an inner surrounding surface thereof, two mounting blocks 3112 each of which extends from an end of the first tube section 311 in the direction of the axis (X), and two outer limiting planes 3113 (only one is visible in FIG. 10) that are formed at an outer surrounding surface thereof and that respectively abut against the inner limiting planes 2111 of one of the first barrels 211. The second tube section 312 has two spaced-apart mounting grooves 3121 each of which extends from an end of the second tube section 312 in the direction of the axis (X) and is engaged with a respective one of the mounting blocks 3112 of the first tube section 311, and two outer limiting planes 3122 that are formed at an outer surrounding surface thereof and that respectively abut against the inner limiting planes 2111 of one of the first barrels 211.

The torsion spring 32 has a middle coil 324, two end coils 323 that are respectively connected to two opposite ends of the middle coil 324, and two end portions 321, 322 each of which is connected to a distal end of a respective one of the end coils 323. Each of the end coils 323 has at least two spirals that are spaced apart from each other by a first distance (D1). The middle coil 324 has a plurality of spirals. Two adjacent ones of the spirals of the middle coil 324 are spaced apart from each other by a second distance (D2). The first distance (D1) is smaller than the second distance (D2).

The adjusting member 33 has a hexagonal adjusting hole 331 (see FIG. 11) that is formed in an end surface thereof and that is exposed from the torsional tubular member 31, a limiting groove 332 that is formed in an outer surrounding surface thereof, a toothed portion 333 that separably engages the toothed portion 3111 of the first tube section 311, and a spring groove 334 that is formed in an end surface thereof and that is co-rotatably engaged with the end portion 321 of the torsion spring 32. The hexagonal adjusting hole 331 of the adjusting member 33 permits a hand tool (not shown) to engage therewith. By rotating the hand tool in a direction, the engagement between the toothed portion 333 of the adjusting member 33 and the toothed portion 3111 of the first tube section 311 can be adjusted so as to adjust the restoring force (i.e., an actuating force) generated by the torsion spring 32.

The limiting rings 34 are respectively disposed between the first tube section 311 and the second tube section 312 and at an end of the second tube section distal from the first tube section 311, and respectively surrounds the end portions 321, 322 of the torsion spring 32 to prevent the end portions 321, 322 of the torsion spring 32 from being separated from the spring groove 334 of the adjusting member 33. The set screw 33 engages threadedly the first tube section 311 of the torsional tubular member 31, and extends into the limiting groove 332 of the adjusting member 33 to limiting movement of the adjusting member 33 along the axis (X).

Figure 12:
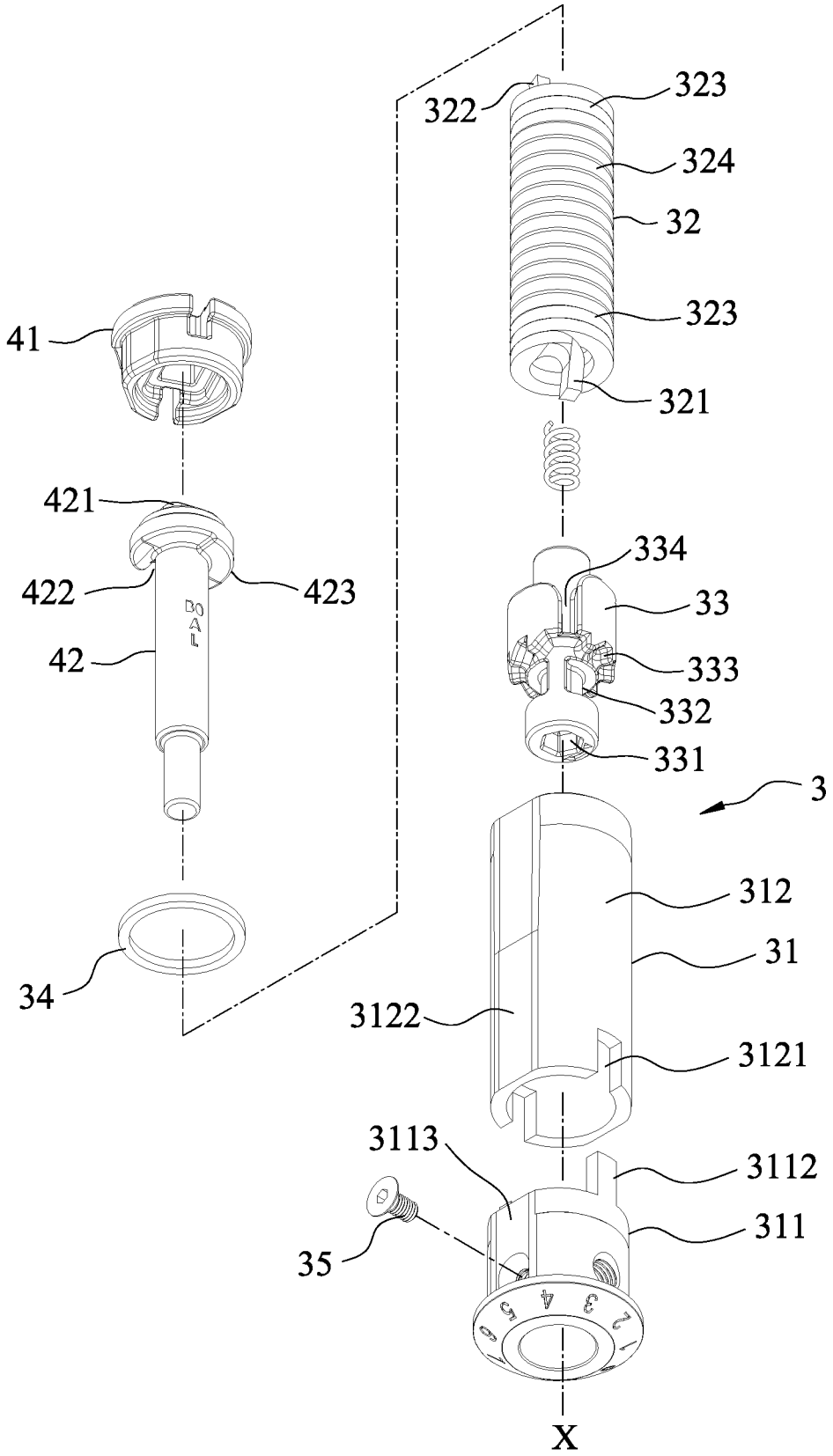
FIG. 12 is an exploded perspective view illustrating the other one of the torsional action units of the second embodiment.
Figure 13:
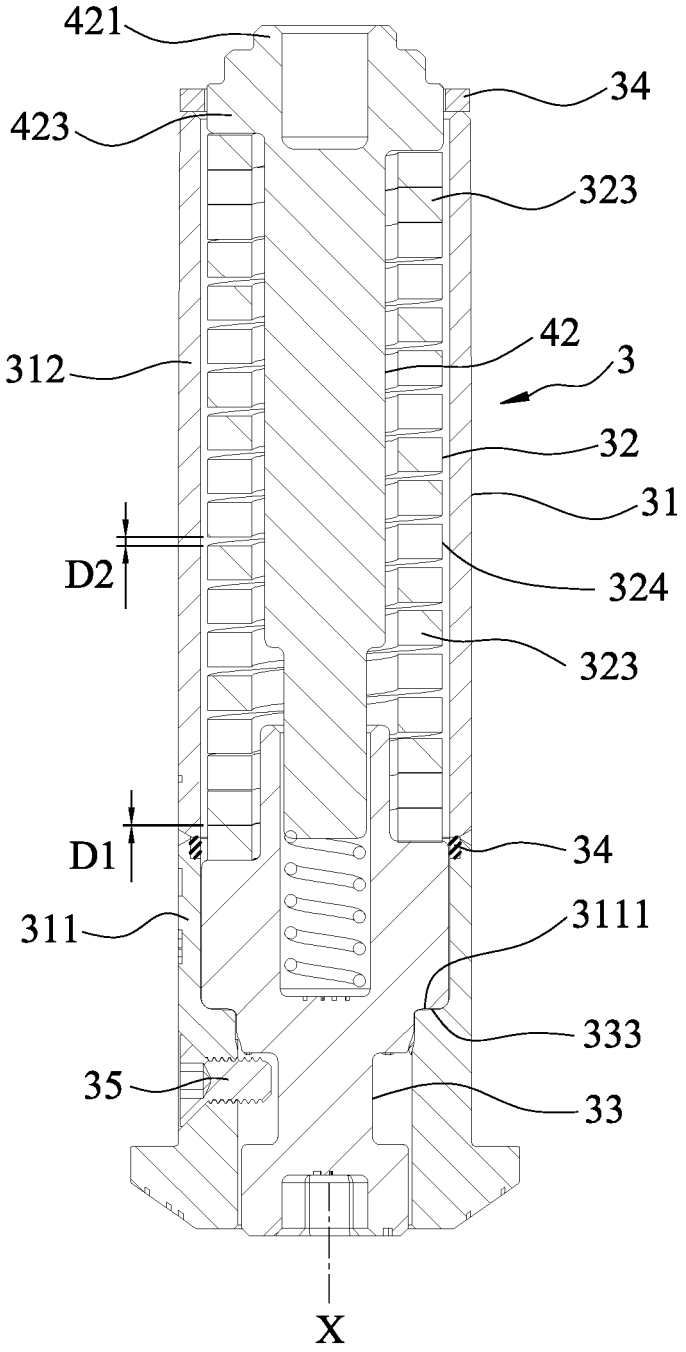
FIG. 13 is a sectional view illustrating the other one of the torsional action units.

Referring to FIGS. 9, 10 and 12, the axle unit includes a fixing member 41 that is removably mounted in the second barrel 221 of the second leaf 22 by a fastener 23 (see FIG. 15) and that is co-rotatable with the second leaf 22, two torsional axles 42 (see FIGS. 10 and 12) each of which is mounted to a respective one of the torsional action units 3 and is co-rotatably connected to the fixing member 41.

The fixing member 41 has a rectangular fixing hole 411 that is formed in one of two opposite end surfaces of the fixing member 41 along the axis (X) and that extends along the axis (X), a fixing recess 412 (see FIG. 9) that is formed in the other one of the opposite end surfaces of the fixing member 41, and two fixing grooves 413 (only one is visible in FIG. 9) that are respectively formed in the opposite end surfaces of the fixing member 41. In one embodiment, the fixing recess 412 is configured as a rectangular recess. In one embodiment, the fixing hole 411 is formed through the opposite end surfaces of the fixing member 41.

Each of the torsional axles 42 extends along the axis (X) through the end coils 323 and the middle coil 324 of the torsion spring 32 of the corresponding torsional action unit 3, and has an axle portion 421, and a flange portion 423 that is formed with a breach 422. The axle portions 421 of the torsional axles 42 respectively and co-rotatably engage the fixing hole 411 and the fixing recess 412 of the fixing member 41 (see FIG. 15). The breaches 422 of the torsional axles 42 are respectively aligned with the fixing grooves 413 of the fixing member 41, so that the end portions 322 of the torsion springs 32 of the torsional action units 3 respectively extend through the breaches 422 of the torsional axles 42 to respectively engage the fixing grooves 413 of the fixing member 41.

Figure 14:
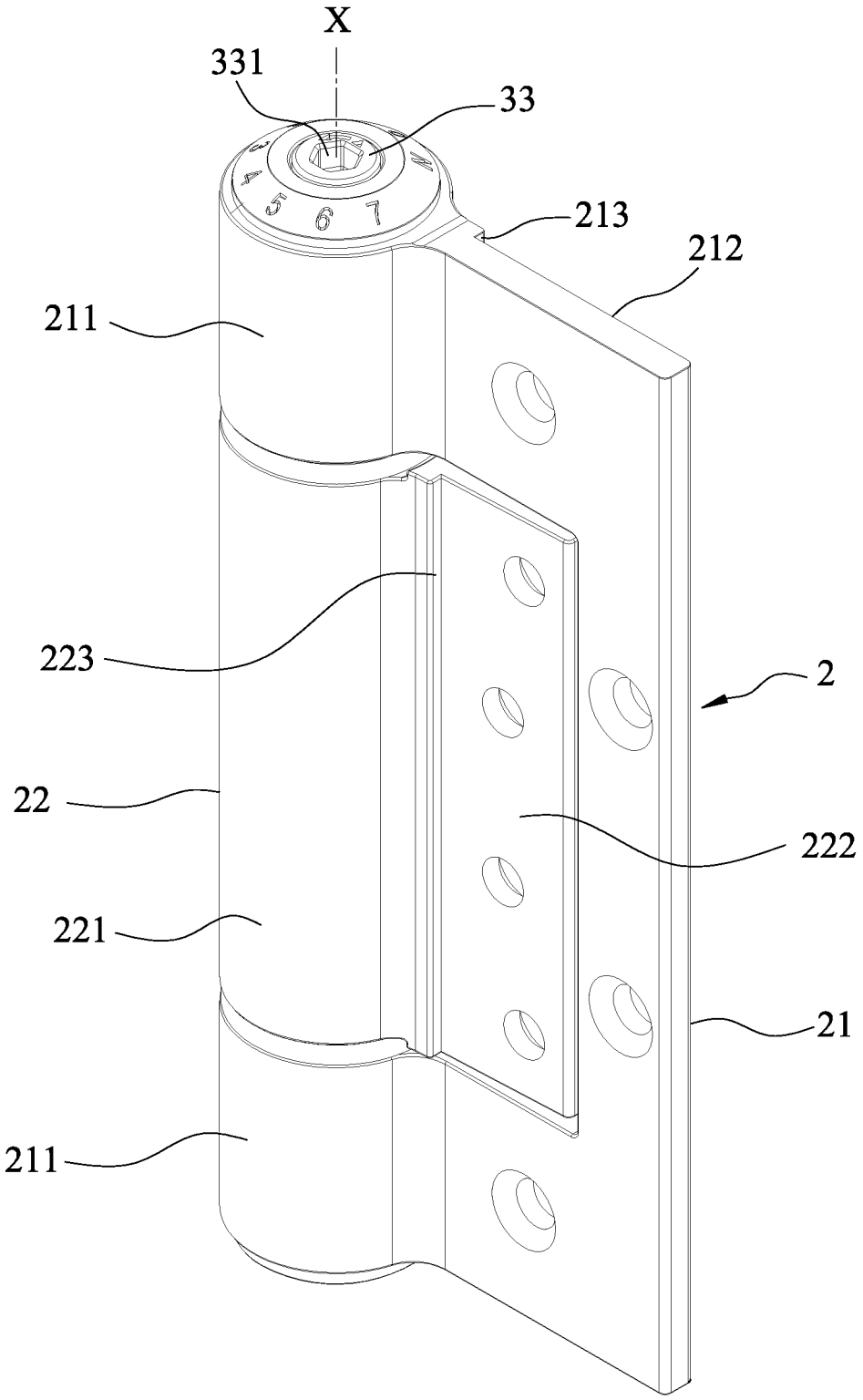
FIG. 14 is an assembled perspective view illustrating the second embodiment.

Referring to FIG. 14, since the second leaf 22 is disposed in the receiving space defined by the U-shaped first leaf 21, the second embodiment is suitable for use on the occasion that a gap between the first and second objects 11, 12 (with reference to FIG. 1) is equal to or slightly greater than the thickness of the first leaf 21. During installation of the hinge onto the first and second objects 11, 12, the first leaf 21 can be quickly and accurately positioned relative to the first object by moving the first positioning surface 213 to abut against the edge 111 of the first object 11, and the second leaf 22 can be quickly and accurately positioned relative to the second object 12 by moving the second positioning surface 223 to abut against the edge 121 of the second object 12. As such, the first and second objects 11, 12 are accurately positioned relative to each other, and can be smoothly rotated relative to each other.

Figure 15:
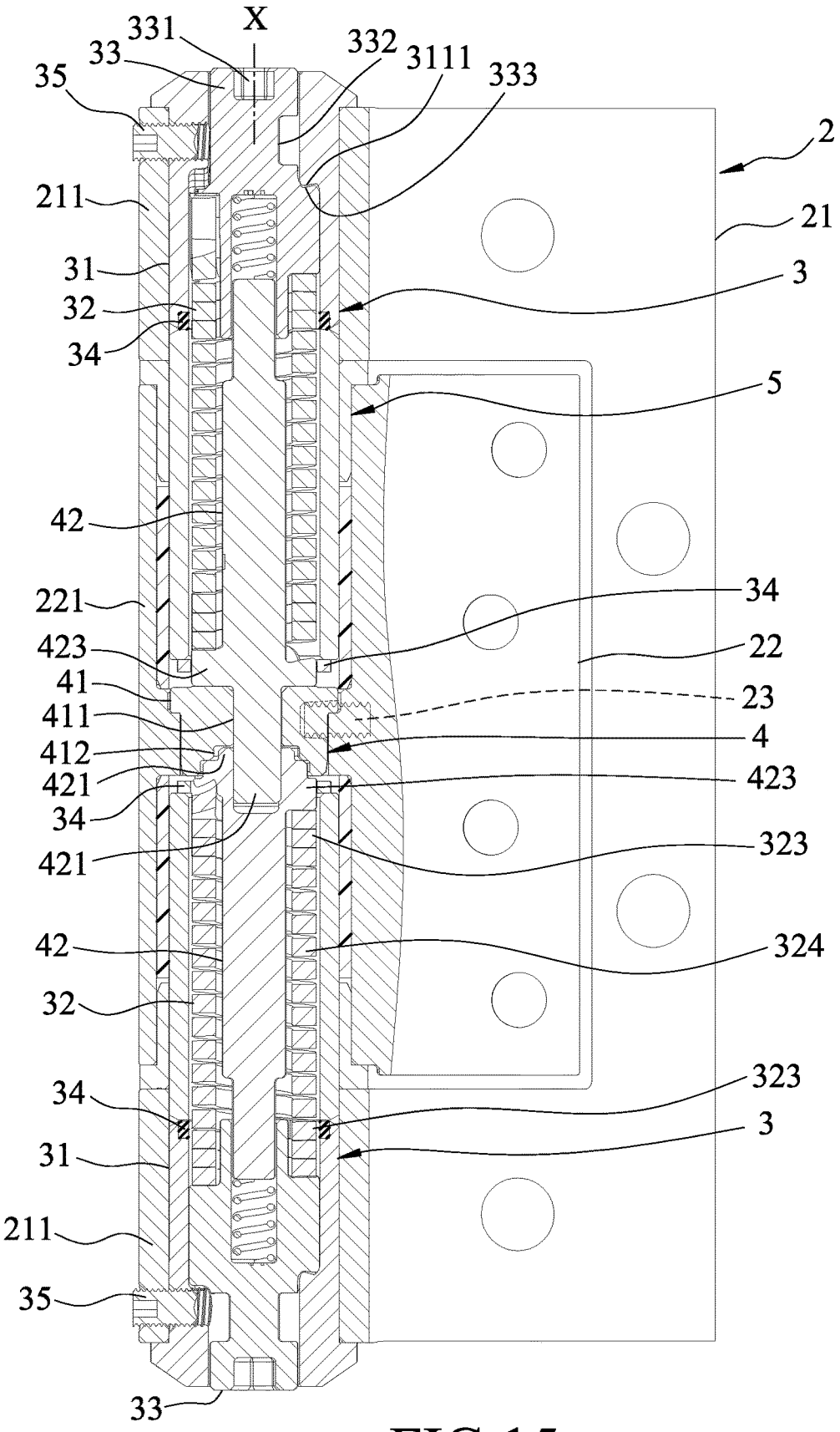
FIG. 15 is a sectional view illustrating the second embodiment.

Referring to FIGS. 9, 14 and 15, when the first and second leaves 21, 22 are rotated relative to each other by an external force, each of the torsional axles 42 is rotated relative to the torsional tubular member 31 of the corresponding torsional action unit 3 to twist the torsion spring 32 of the corresponding torsional action unit 3 in a direction such that the diameter of the torsion spring 32 decreases and that each of the first and distances (D1, D2) decreases so as to generate a restoring force (i.e., an actuating force). By such, when the external force is removed, the torsion spring 32 of each of the torsional action units 3 restores to rotate the first and second leaves 21, 22 relative to each other.

The second embodiment employs two torsion springs 32 to generate the restoring force, and is therefore suitable for a heavy door leaf. It should be noted that after the torsion spring 32 is twisted by an external force such that any two adjacent ones of the spirals of each of the end coils 323 abut against each other (i.e., D1=0, D2≠0), further relative rotation between the corresponding adjusting member 33 and the corresponding torsional axle 42 caused by the external force would only deform the middle coil 324 (because the end coils 323 cannot be further deformed). Accordingly, in the case that each of the middle coil 324 and the end coils 323 has the same number of spirals, upon each relative rotation between the corresponding adjusting member 33 and the corresponding torsional axle 42 by a predetermined angle caused by the external force, the increment of the restoring force generated by the torsion spring 32 at the time that any two adjacent ones of the spirals of each of the end coils 323 abut against each other is three times the increment of the restoring force generated by the torsion spring 32 at the time that the spirals of each of the end coils 323 are spaced apart from each other. As such, the second embodiment is suitable for a heavy door leaf.

It should be noted that the first leaf 21 can be connected to any one of a door leaf and a door frame while the second leaf 22 is connected to the other one of the door leaf and the door frame.

Figure 16:
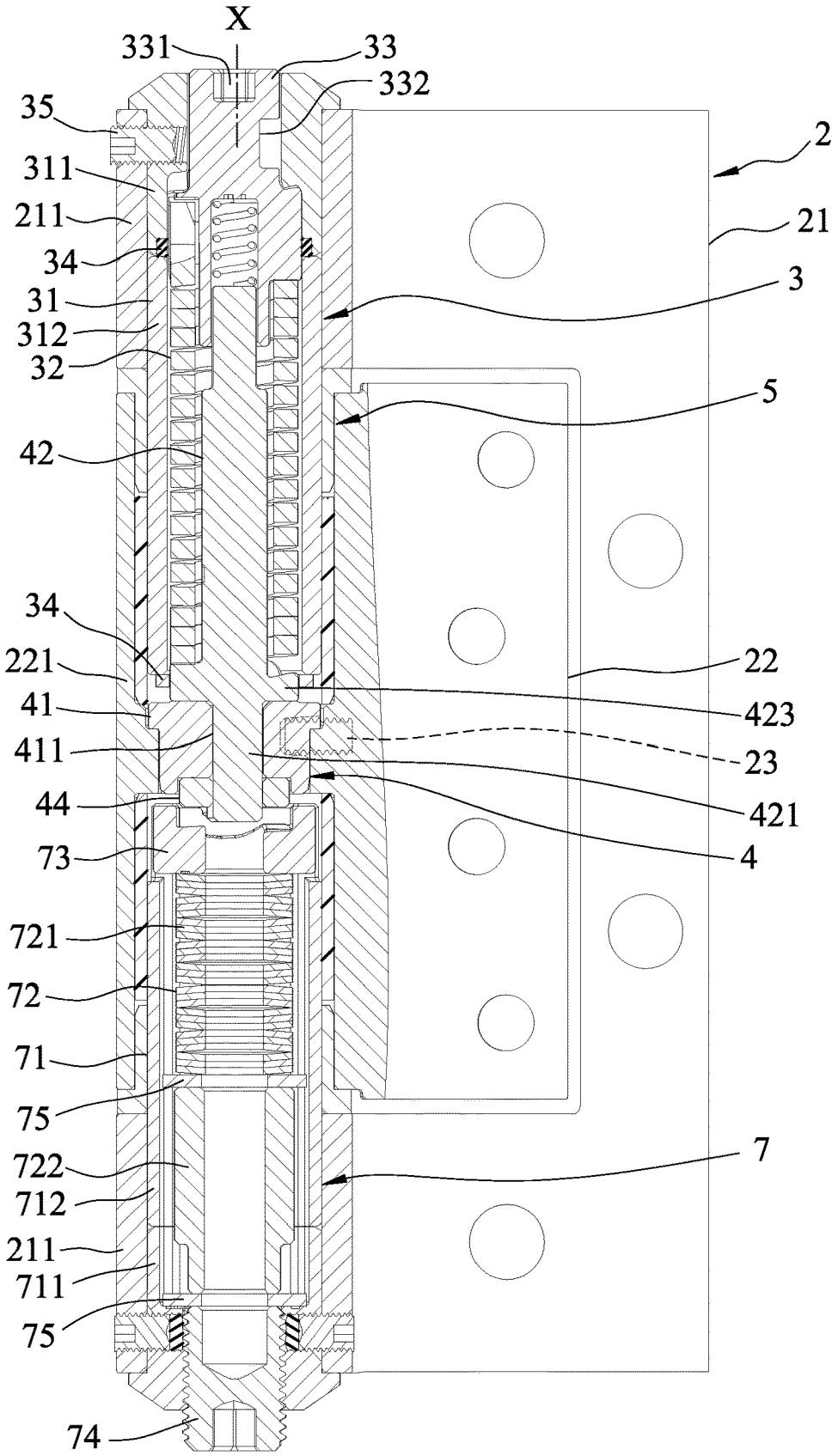
FIG. 16 is a sectional view illustrating a third embodiment of the hinge according to the disclosure.

Referring to FIG. 16, a third embodiment of the hinge according to the disclosure is similar to the second embodiment, and includes the leaf unit 2, the axle unit 4, the ring unit 5, the torsional action unit 3 and the second action unit 7. The axle unit 4 of the third embodiment includes the fixing member that is removably mounted in the second barrel 221 of the second leaf 22 by the fastener 23 and that is co-rotatable with the second leaf 22, the torsional axle 42 that is mounted to the torsional action unit 3 and that is co-rotatably connected to the fixing member 41, and the second axle constituent 44 that is mounted to the second action unit 7 and that is co-rotatably connected to the fixing member 41.

The cooperation of the components of the third embodiment can be comprehended by one of ordinary skill in the art with reference to the preceding paragraphs, and would not be further described.

Figure 17:
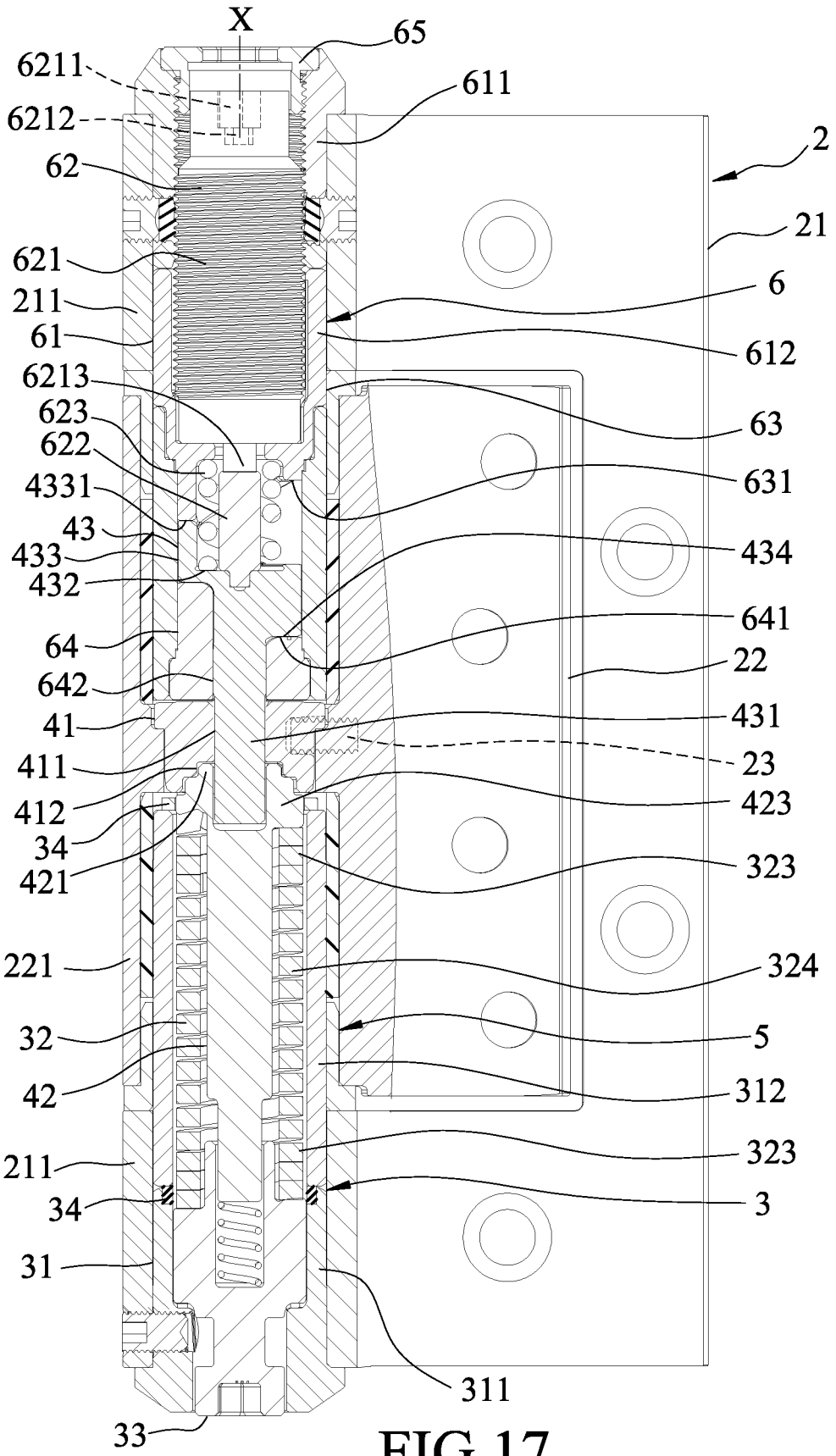
FIG. 17 is a sectional view illustrating a fourth embodiment of the hinge according to the disclosure.

Referring to FIG. 17, a fourth embodiment of the hinge according to the disclosure is similar to the second embodiment, and includes the leaf unit 2, the axle unit 4, the ring unit 5, the torsional action unit 3 and the first action unit 6. The axle unit 4 of the fourth embodiment includes the fixing member 41 that is removably mounted in the second barrel 221 of the second leaf 22 by the fastener 23 and that is co-rotatable with the second leaf 22, the torsional axle 42 that is mounted to the torsional action unit 3 and that is co-rotatably connected to the fixing member 41, and the first axle constituent 43 that is mounted to the first action unit 6 and that is co-rotatably connected to the fixing member 41.

The cooperation of the components of the fourth embodiment can be comprehended by one of ordinary skill in the art with reference to the preceding paragraphs, and would not be further described.

Figure 18:
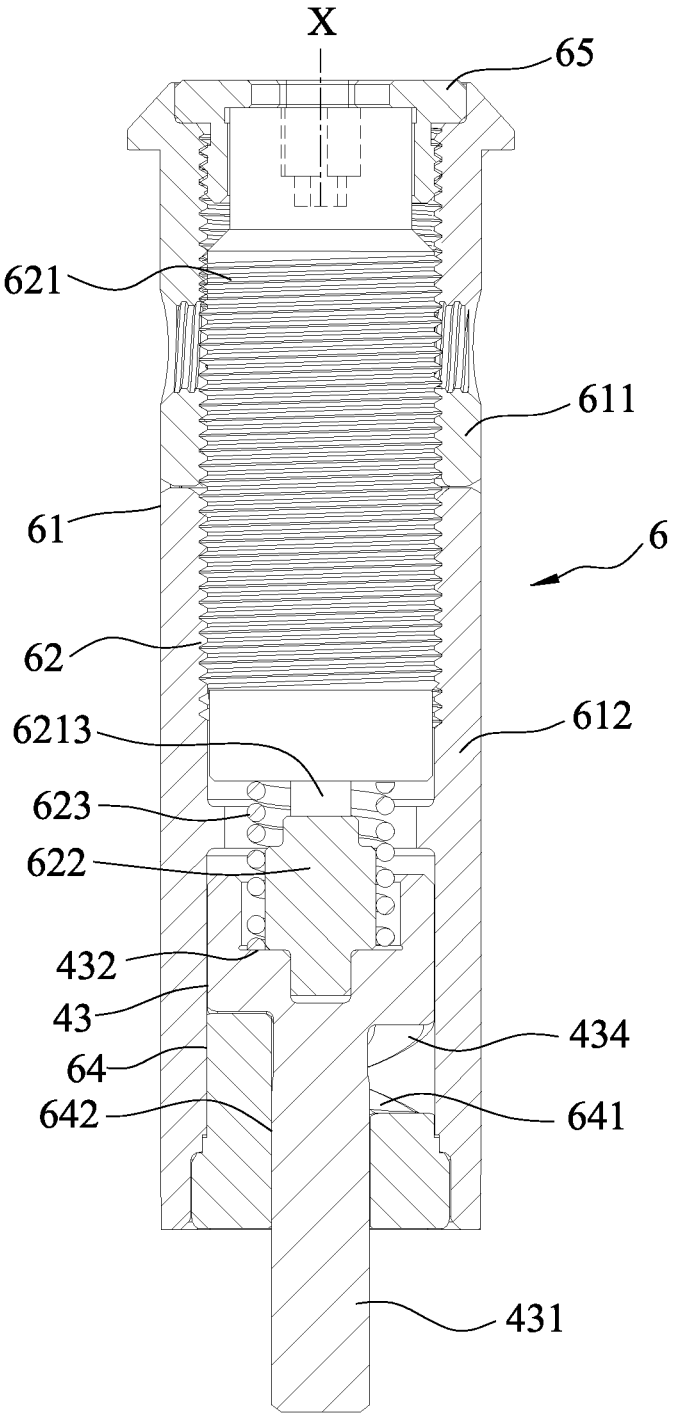
FIG. 18 is a sectional view illustrating a modification of the first action unit.

Referring to FIG. 18, a modification of the first action unit 6 includes the first tubular member 61 that is inserted into the first and second barrels 211, 221 (see FIG. 2) and that is co-rotatable with the first barrels 211, the hydraulic module 62 that is disposed in the first tubular member 61, the proximal acting member 64 that is co-rotatably mounted in the first tubular member 61, and the cap member 65 that is mounted to an end of the first tubular member 61. It should be noted that the distal acting member 63 (see FIG. 3) is omitted. The operation of the modification is similar to that of the first action unit 6 shown in FIG. 4, and would not be further described.

Figure 19:
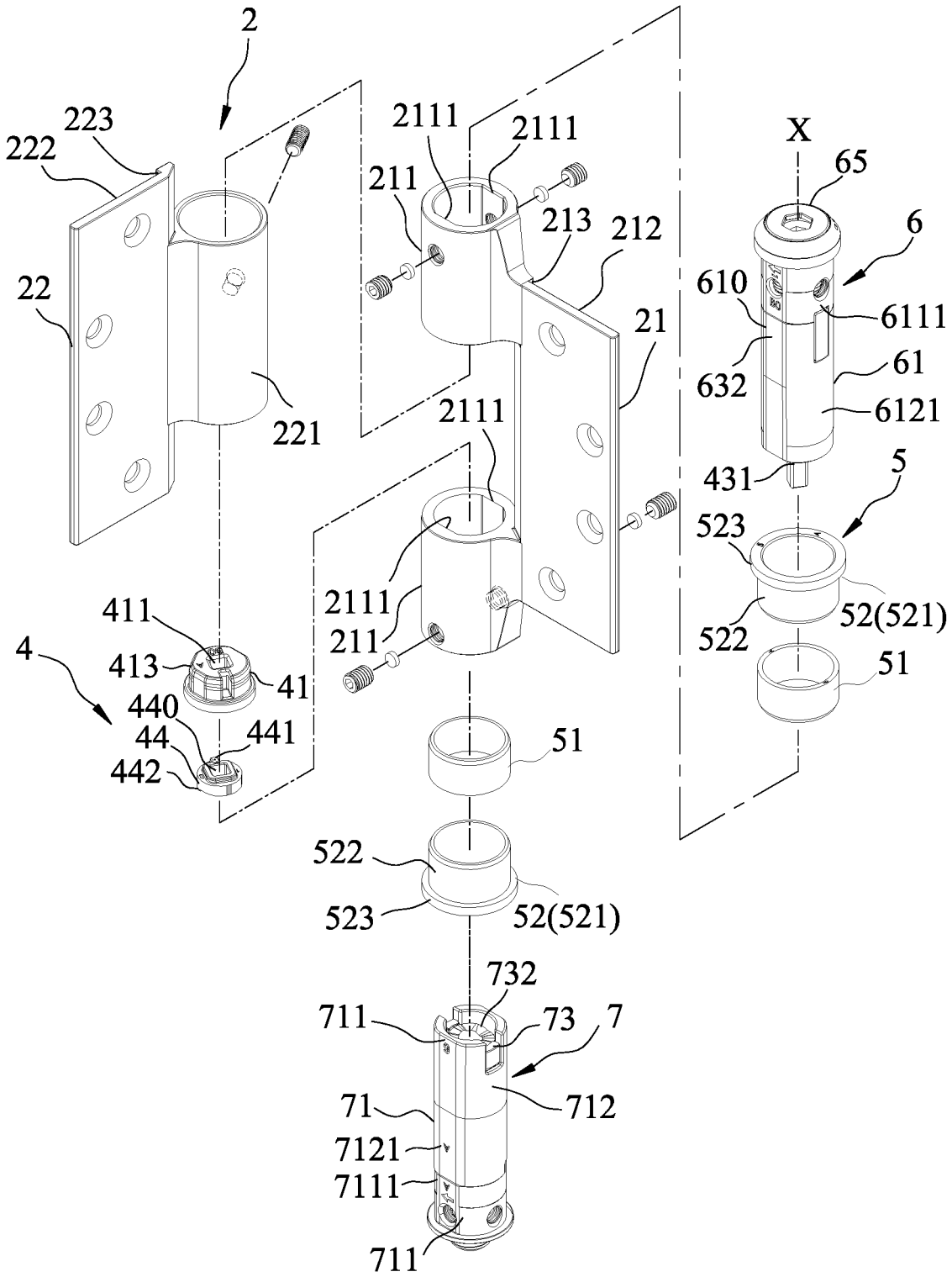
FIG. 19 is a partly exploded perspective view illustrating a fifth embodiment of the hinge according to the disclosure.
Figure 20:
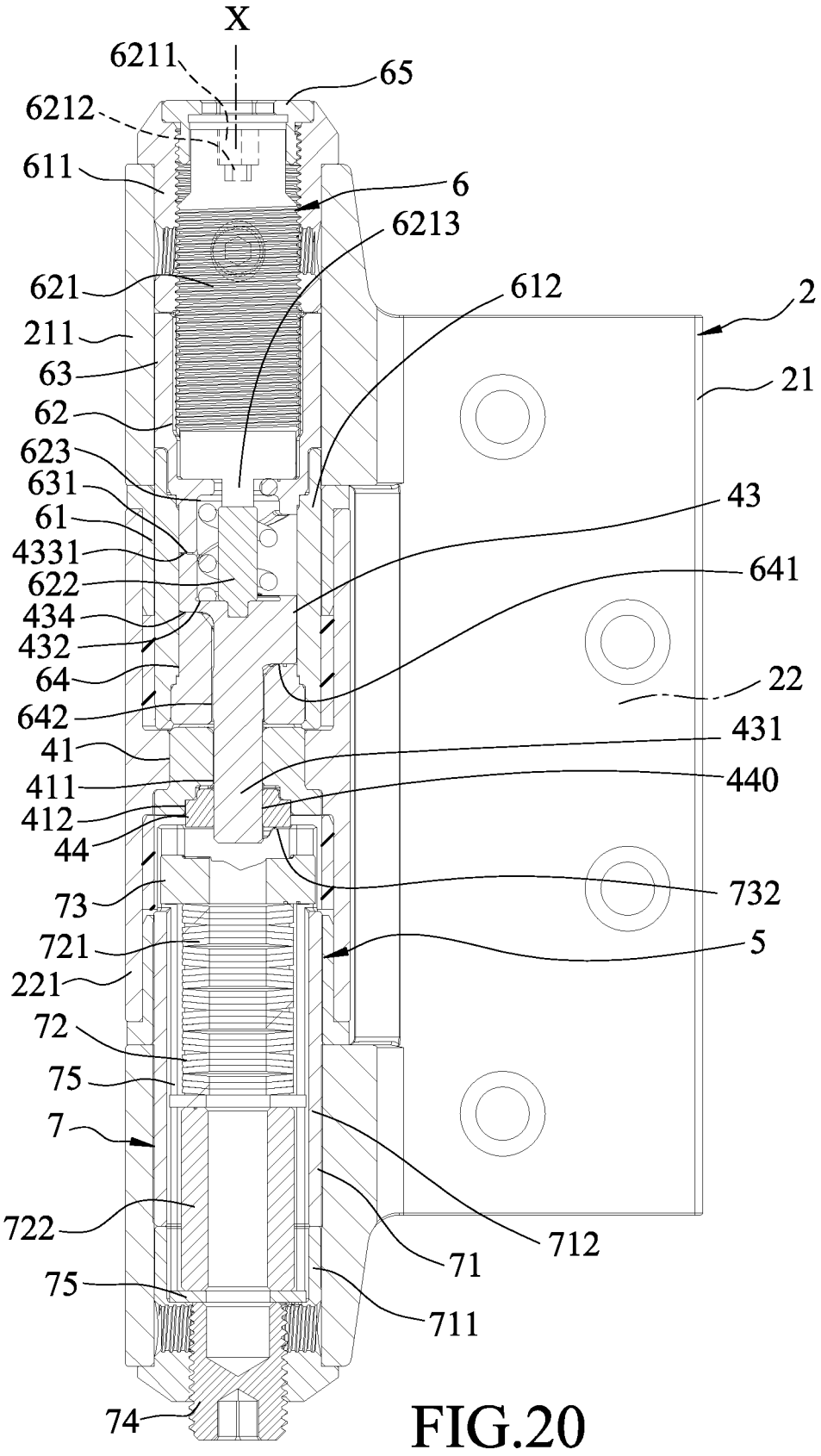
FIG. 20 is a sectional view illustrating the fifth embodiment.

Referring to FIGS. 19 and 20, a fifth embodiment of the hinge according to the disclosure is similar to the first embodiment, and includes the leaf unit 2, the axle unit 4, the ring unit 5, the first action unit 6 and the second action unit 7.

The fixing member 41 has a different configuration such that the fixing member 41 and the second axle 44 are moved into the second barrel 221 of the second leaf 22 via the lower opening of the second barrel 221. The axle portion 431 of the first axle constituent 43 engages the fixing hole 411 of the fixing member 41 and the fixing hole 440 of the second axle 44, so the fixing member 41, the first axle constituent 43 and the second axle constituent 44 are co-rotatable. The protrusions 442 (only one is visible in FIG. 19) of the second axle constituent 44 are in frictional contact with the friction surface 732 of the friction member 73 of the second action unit 7.

Figure 21:
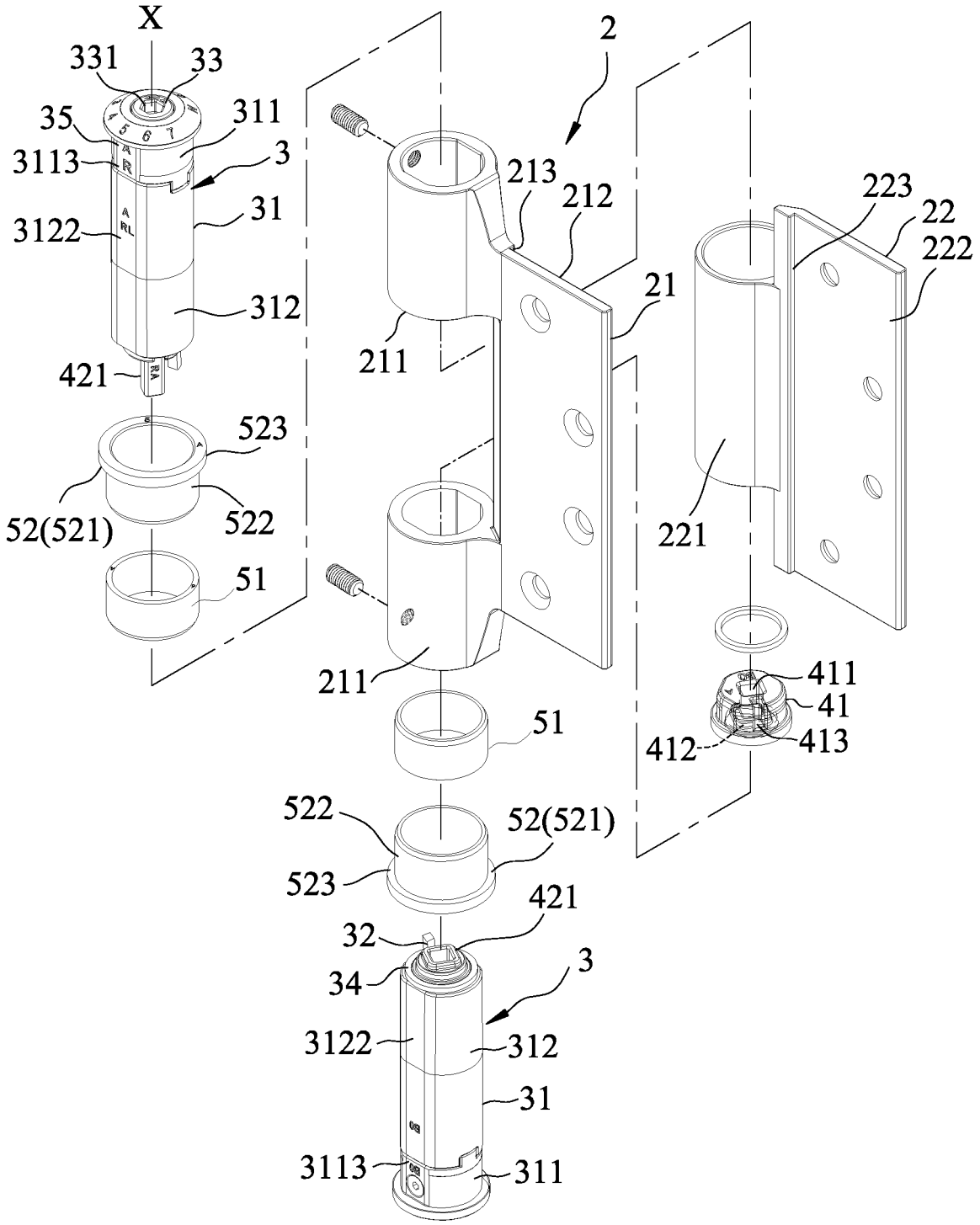
FIG. 21 is a partly exploded perspective view illustrating a sixth embodiment of the hinge according to the disclosure.
Figure 22:
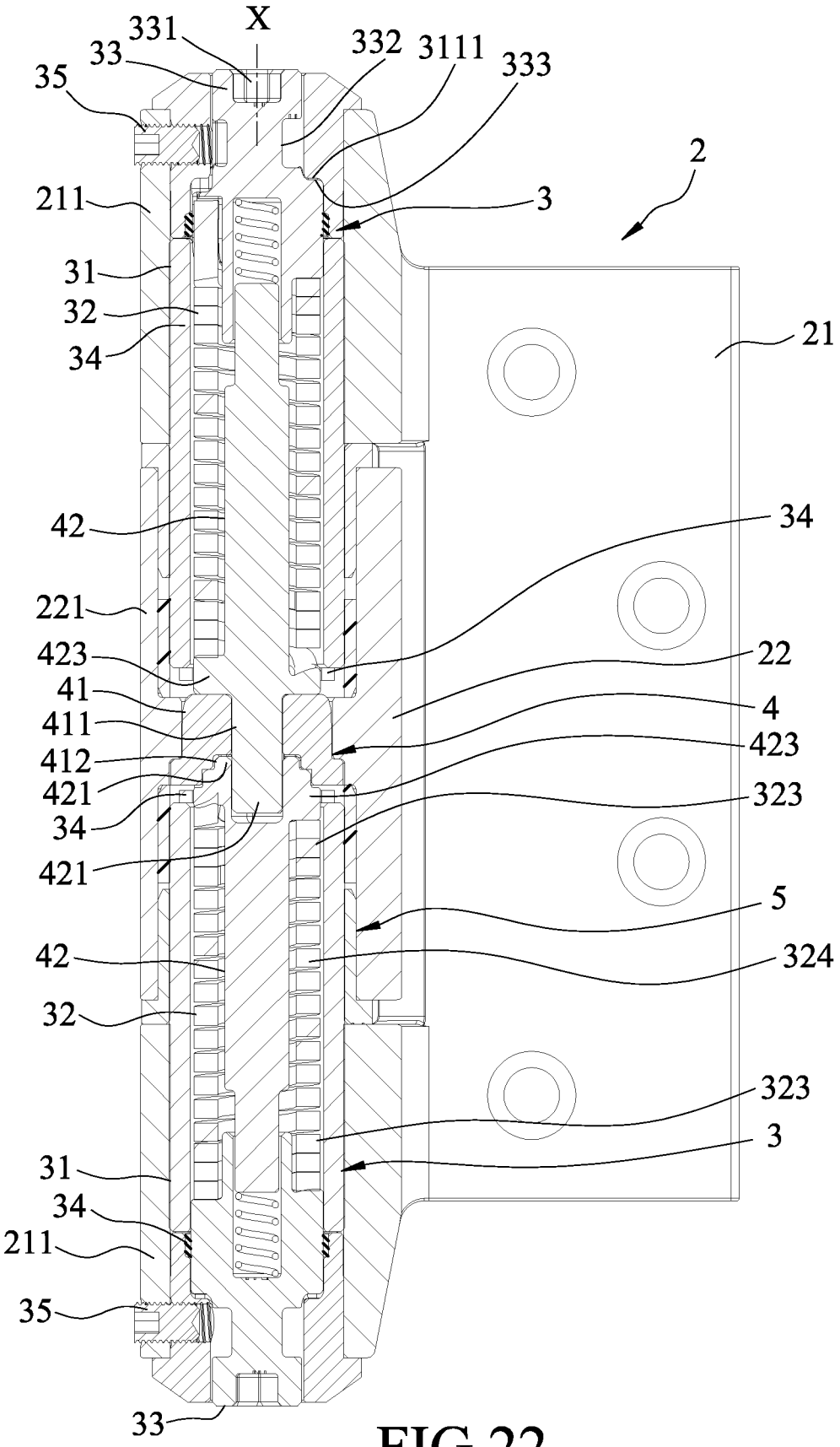
FIG. 22 is a sectional view illustrating the sixth embodiment.

Referring to FIGS. 21 and 22, a sixth embodiment of the hinge according to the disclosure is similar to the second embodiment, and includes the leaf unit 2, the axle unit 4, the ring unit 5, and the torsional action units 3.

The fixing member 41 has a different configuration, and is moved into the second barrel 221 of the second leaf 22 via the lower opening of the second barrel 221. The axle portions 421 of the torsional axles 42 respectively and co-rotatably engage the fixing hole 411 and the fixing recess 412 of the fixing member 41 (see FIG. 22). The breaches 422 of the torsional axles 42 are respectively aligned with the fixing grooves 413 of the fixing member 41, so that the end portions 322 of the torsion springs 32 of the torsional action units 3 respectively extend through the breaches 422 of the torsional axles 42 to respectively engage the fixing grooves 413 of the fixing member 41.

Figure 23:
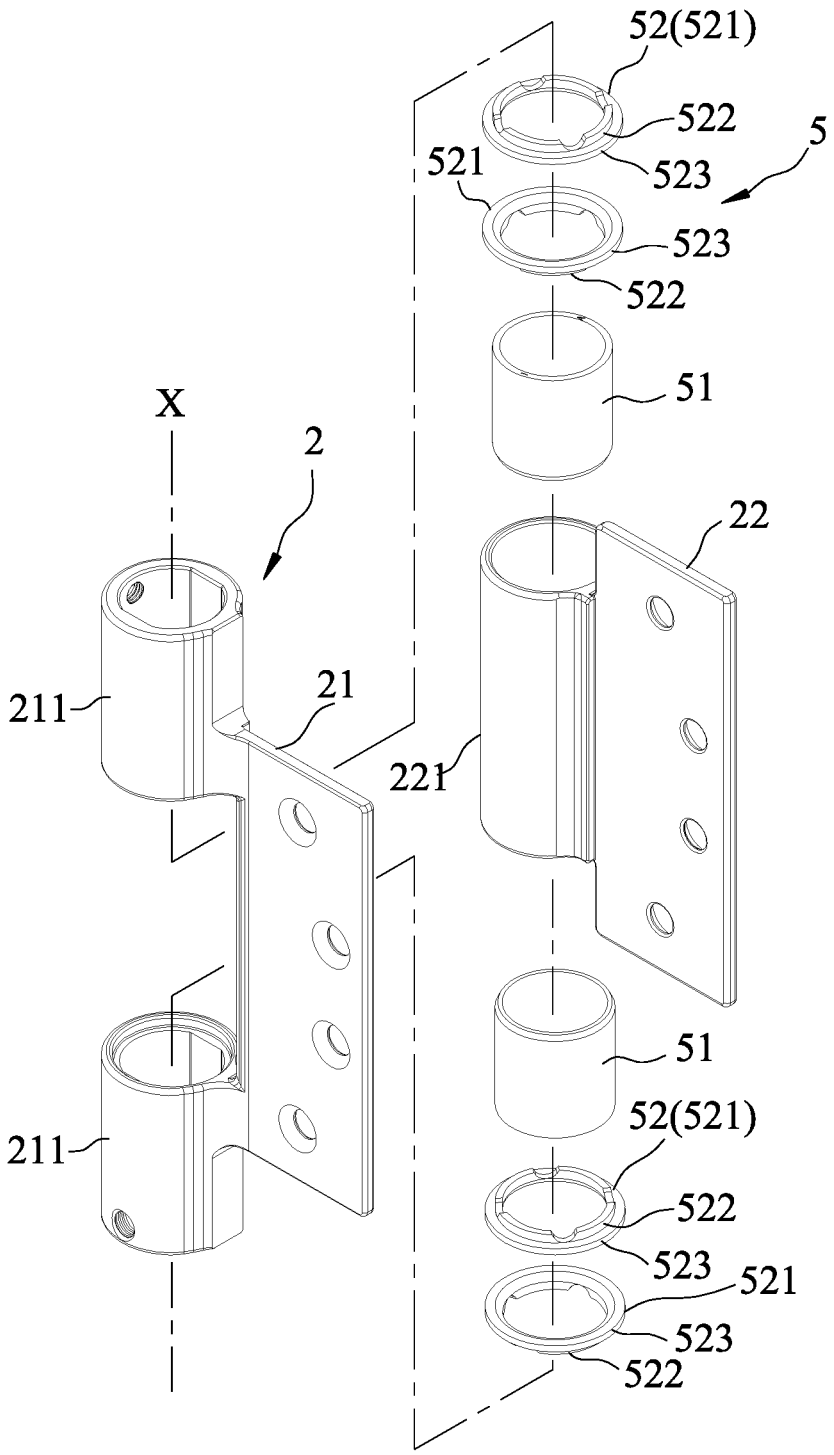
FIG. 23 is a partly exploded perspective view illustrating a modification of a ring unit of the hinge according to the disclosure.
Figure 24:
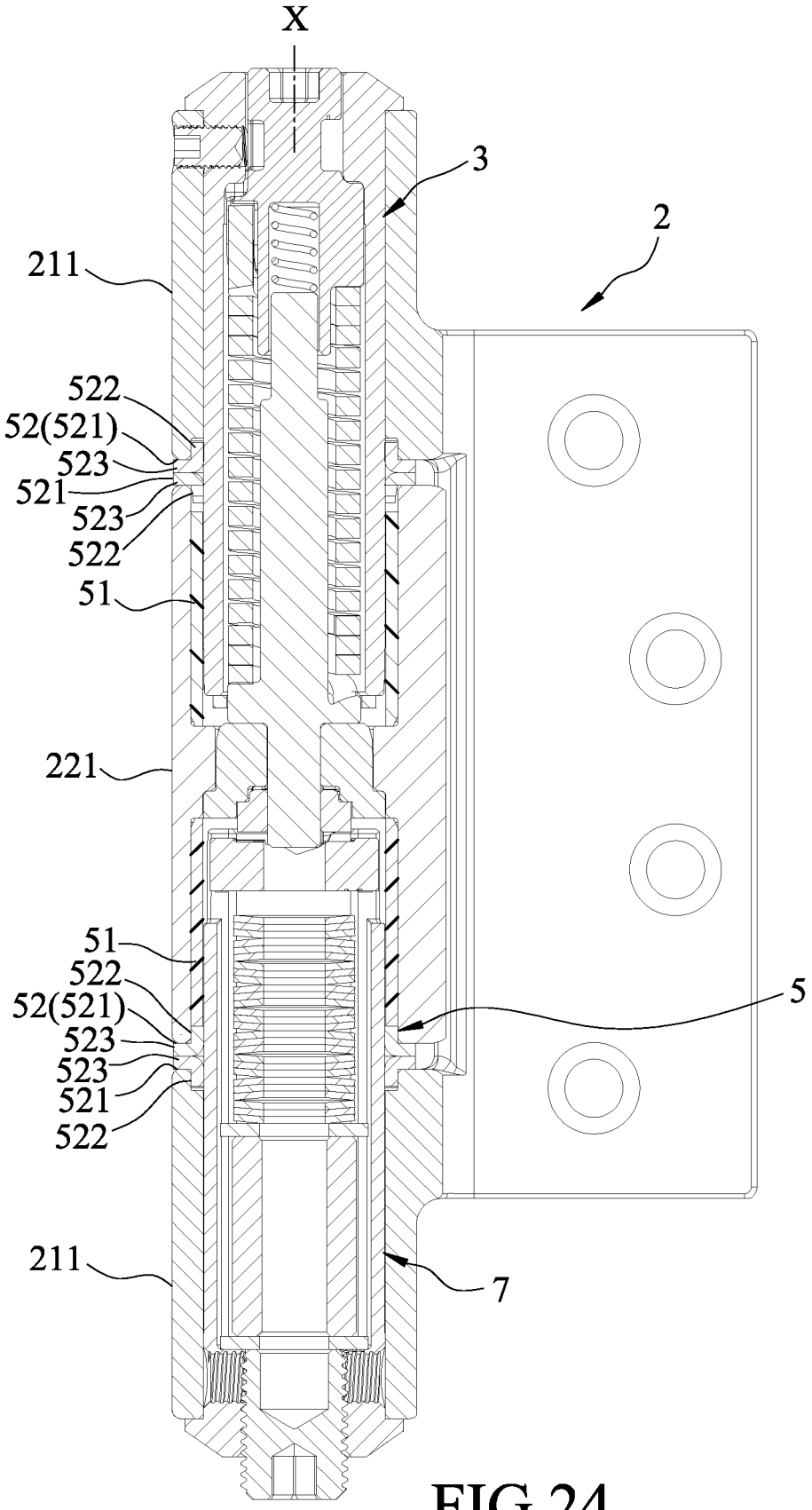
FIG. 24 is a sectional view illustrating the modification of the ring unit.

Referring to FIGS. 23 and 24, in some embodiment, each of the spacer assemblies 52 may includes two spacers 521. The surrounding walls 522 of the spacers 521 of each of the spacer assemblies 52 respectively extend into the second barrel 221 and one of the first barrel 211, and the flange wall 523 of the spacers 521 of each of the spacer assemblies 52 abut against each other and are disposed between the second barrel 221 and the one of the first barrels 211.

In some embodiment, each of the ring members 51 may be made of Polyoxymethylene (POM) or Polytetrafluoroethylene (PTFE), and serves as a bushing for facilitating relative rotation between the corresponding components. Each of the spacer assemblies 52 may be made of metal, such as aluminum, so as to be wear-resistant. Moreover, the material of the first barrels 211, the second barrel 221 and the exposed flange wall 523 of the spacers 521 of each of the spacer assemblies 52 may be similar to each other, so the hinge may be visually aesthetic.

Figure 25:
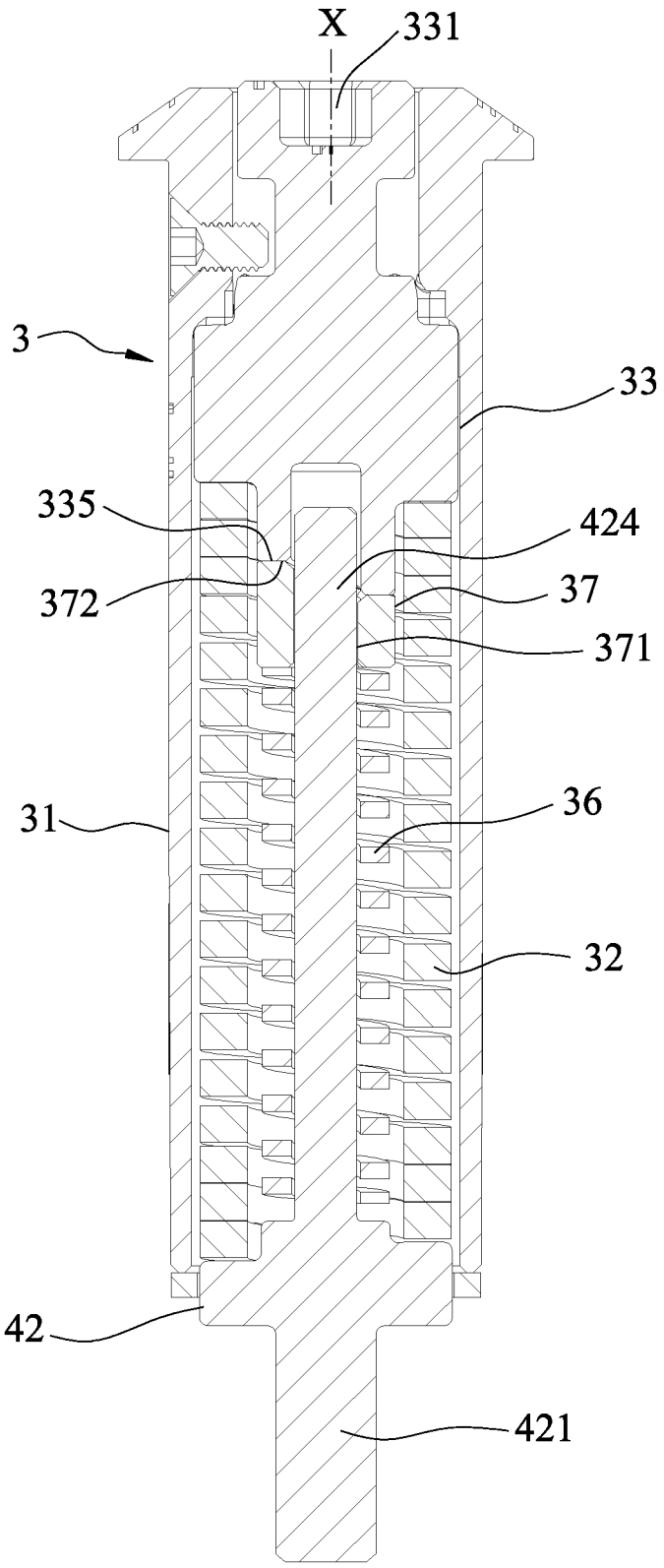
FIG. 25 is a sectional view illustrating a modification of the torsional action unit of the hinge according to the disclosure.

Referring to FIG. 25, a modification of the torsional action unit 3 further includes an auxiliary spring 36 and a slide block 37.

The torsional axle 42 further has a rectangular auxiliary axle portion 424 that is opposite to the axle portion 421.

The adjusting member 33 further has an inclined surface 335 that is opposite to the hexagonal adjusting hole 331.

The auxiliary spring 36 is sleeved on the torsional axle 42, and is surrounded by the torsion spring 32.

The slide block 37 abuts against an end of the auxiliary spring 36, and has a rectangular hole 371 that is engaged with the auxiliary axle portion 424 of the torsional axle 42, and an inclined surface 372 that is opposite to the auxiliary spring 36 and that is in slidable contact with the inclined surface 335 of the adjusting member 33. The slide block 37 is co-rotatable with the torsional axle 42, and is movable along the auxiliary axle portion 424 of the torsional axle 42 along the axis (X).

Figure 26:
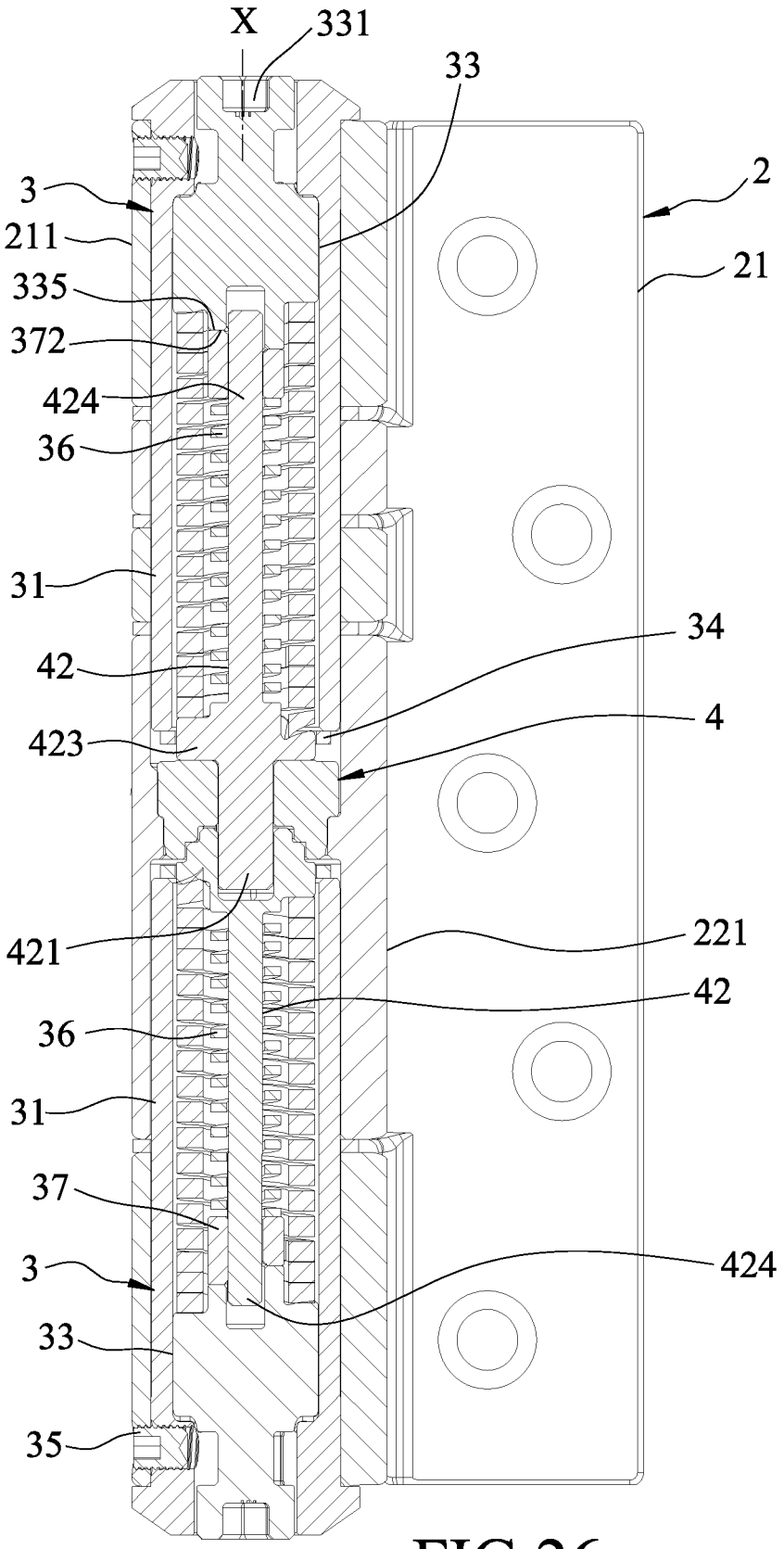
FIGS. 26 and 27 are sectional views illustrating operation of the modification of the torsional action unit.
Figure 27:
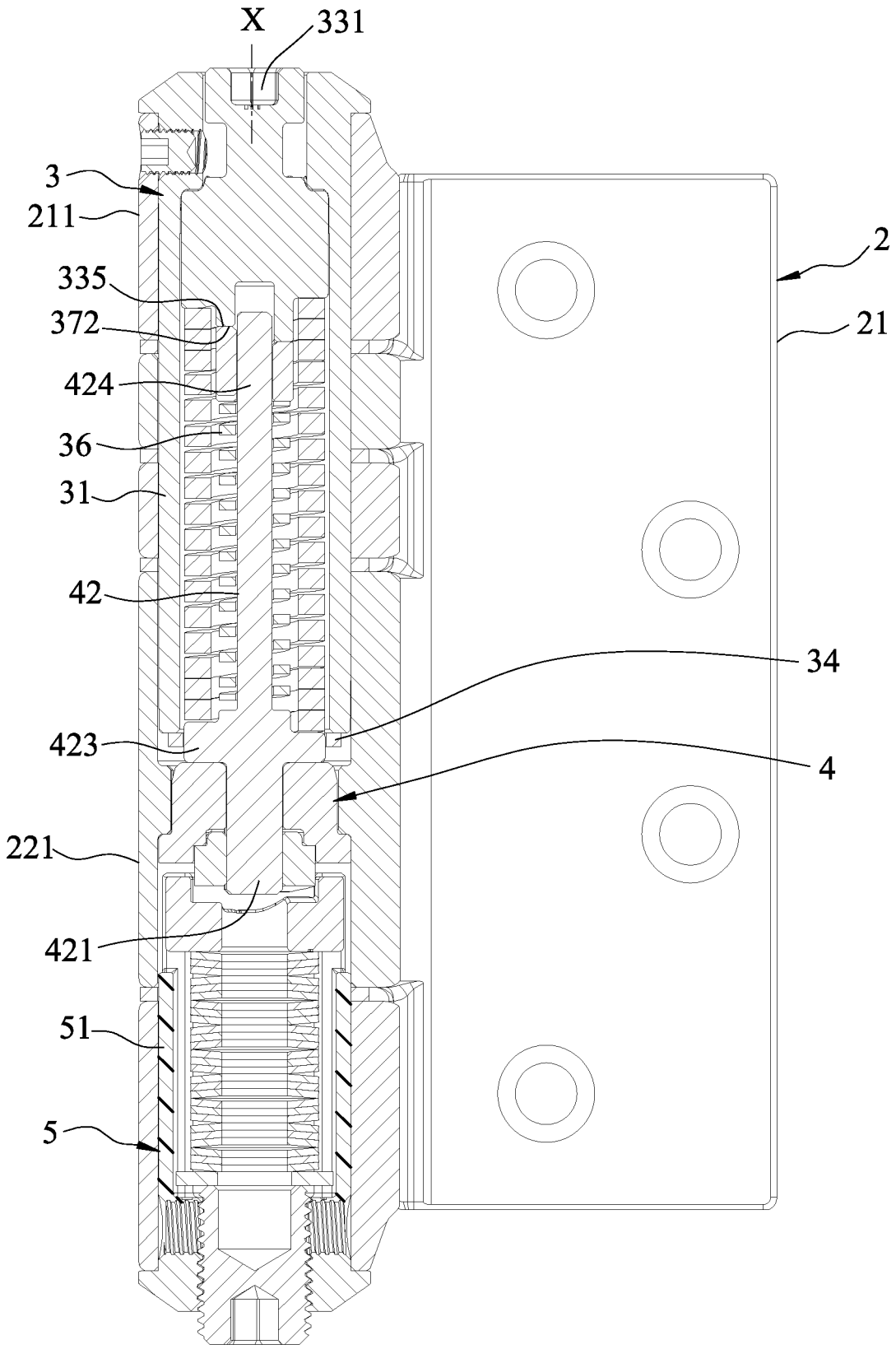

Referring to FIGS. 26 and 27, when the first and second leaves 21, 22 are rotated relative to each other by an external force, the torsional axle 42 and the slide block 37 are rotated relative to each other, so that the inclined surface 335 of the adjusting member 33 pushes the inclined surface 372 of the slide block 37 to move the slide block 37 away from the adjusting member 33 along the axis (X) to compress the auxiliary spring 36 so as to generate a restoring force. When the external force is removed, the torsion spring 32 and the auxiliary spring 36 restore to rotate the first and second leaves 21, 22 relative to each other, and to move the slide block 37 toward the adjusting member 33 along the axis (X).

In summary, the advantages of the disclosure are as follows:

1. The torsional axle 42, the first axle constituent 43 or the second axle constituent 44 can be easily and co-rotatably mounted to the second barrel 221 of the second leaf 22 by virtue of the fixing member 41 that is removably mounted in the second barrel 221 without forming mounting structures on the inner surrounding surface of the second barrel 221. Moreover, a worn fixing member 41 can be easily substituted with a new fixing member 41.

2. Each of the ring members 51 and the spacer assemblies 52 serves as a bushing for facilitating relative rotation between the corresponding components.

3. The configuration of the torsion spring 32 enables the torsion spring 32 to generate a greater restoring force.

4. Each of the second and the subsequent embodiments is suitable for use on the occasion that a gap between the first and second objects 11, 12 (with reference to FIG. 1) is equal to or slightly greater than the thickness of the first leaf 21 since the second leaf 22 is disposed in the receiving space defined by the U-shaped first leaf 21.

5. During installation of the hinge onto the first and second objects 11, 12, the first leaf 21 can be quickly and accurately positioned relative to the first object 11 by moving the first positioning surface 213 to abut against the edge 111 of the first object 11, and the second leaf 22 can be quickly and accurately positioned relative to the second object 12 by moving the second positioning surface 223 to abut against the edge 121 of the second object 12. Therefore, the first and second objects 11, 12 are accurately positioned relative to each other, and can be smoothly rotated relative to each other.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A hinge adapted to interconnect first and second objects comprising:

a leaf unit including first and second leaves that are rotatable relative to each other, said first leaf having at least one first barrel, said second leaf having at least one second barrel that is spaced apart from said first barrel along an axis;

first and second action units being inserted into said first barrel and said second barrel respectively in two opposite directions along the axis, and being co-rotatable with said first leaf; and an axle unit including a fixing member that is mounted in said second barrel of said second leaf, that has a through hole, and that is co-rotatable with said second leaf, and first and second axle constituents that are respectively connected to said first and second action units and that are co-rotatably mounted to said fixing member, each of said first and second axle constituents and the respective one of said first and second action units being rotated relative to each other upon relative rotation between said first and second leaves;

wherein said first action unit includes a tubular member that is inserted into said first and second barrels and that is co-rotatable with said first leaf, a hydraulic module that is disposed in said tubular member, a proximal acting member that is co-rotatably mounted in said tubular member, and a cap member that is mounted to an end of said tubular member, said hydraulic module including a hydraulic cylinder, an abutment pin that is disposed between said hydraulic cylinder and said first axle constituent, and a resilient member that is disposed between said hydraulic cylinder and said first axle constituent, said proximal acting member having a proximal inclined surface that faces away from said fixing member, and a through hole that permits said first axle constituent to extend therethrough, said first axle constituent having an abutment surface that abuts against said abutment pin and said resilient member, and a proximal follower surface that is opposite to said abutment surface and that is in contact with said proximal inclined surface of said proximal acting member, said first axle constituent moving along the axis upon the relative rotation between said first and second leaves; and wherein said first action unit further includes a distal acting member that is co-rotatably mounted in said tubular member, said first axle constituent further having a distal follower surface that is opposite to said proximal follower surface, said distal acting member being located between said hydraulic cylinder and said first axle constituent, and having a distal inclined surface that is in contact with said distal follower surface of said first axle constituent.

2. The hinge as claimed in claim 1, wherein said first leaf further has a first clinging surface that clings to the first object, and a first positioning surface that is parallel to the axis, that is connected to said first clinging surface and that is not coplanar with said first clinging surface, said first positioning surface permitting an edge of the first object to abut thereagainst.

3. The hinge as claimed in claim 1, wherein said second leaf further has a second clinging surface that clings to the second object, and a second positioning surface that is parallel to the axis, that is connected to said second clinging surface and that is not coplanar with said second clinging surface, said second positioning surface permitting an edge of the second object to abut thereagainst.

4. The hinge as claimed in claim 1, further comprising a ring unit, said ring unit including a plurality of ring members and a spacer assembly, said ring members being respectively disposed between one of said action units and said second barrel and between the other one of said action units and said second barrel, said spacer assembly including at least one spacer, said at least one spacer having an surrounding wall that is disposed between said second barrel and one of said action units, and a flange wall that is disposed between said first barrel and said second barrel.

5. The hinge as claimed in claim 4, wherein each of said first leaf, said second leaf and said spacer is made of metal, each of said ring members being made of Polyoxymethylene (POM) or Polytetrafluoroethylene (PTFE).

6. The hinge as claimed in claim 1, wherein said second action unit includes a tubular member that is inserted into said first and second barrels and that is co-rotatable with said first leaf, a disc spring assembly that is disposed in said tubular member, a friction member that abuts against said disc spring assembly and that is co-rotatable with said tubular member, and an adjusting member that engages threadably said tubular member, said friction member having a friction surface that is in frictional contact with said second axle constituent, so that said second action unit generates a force that acts between said first and second leaves when said second axle constituent and said second action unit are rotated relative to each other.

7. The hinge as claimed in claim 6, wherein said fixing member has a rectangular fixing hole that extends along the axis, and a fixing groove, said second axle constituent having two protrusions that protrude toward said friction surface of said friction member and that are in frictional contact with said friction surface, and a post that co-rotatably engages said fixing groove of said fixing member, said first axle constituent co-rotatably engaging said fixing hole of said fixing member.

8. The hinge as claimed in claim 1, wherein said hydraulic cylinder threadably engages said tubular member, and has a hexagonal setting hole that extend along the axis and that is accessible through said cap member, said hexagonal setting hole of said hydraulic cylinder permitting a hand tool to engage therewith for adjusting the relative position between said hydraulic cylinder and said tubular member.

9. The hinge as claimed in claim 1, wherein said first barrel has two inner limiting planes that are formed on an inner surrounding surface thereof, each of said first and second action units including a tubular member that is inserted into said first and second barrels and that is co-rotatable with said first leaf, said tubular member of each of said first and second action units having two outer limiting planes that are formed at an outer surrounding surface thereof and that respectively abut against said inner limiting planes of said first barrel.

10. The hinge as claimed in claim 9, wherein said tubular member of at least one of said first and second action units includes a first tube section, and a second tube section that is connected to said first tube section, a location where said first tube section and said second tube section are interconnected being located within said first barrel.

11. The hinge as claimed in claim 1, wherein said fixing member is removably mounted in said second barrel of said second leaf.

* * * * *